US007627127B2

(12) United States Patent
Aida et al.

(10) Patent No.: US 7,627,127 B2
(45) Date of Patent: Dec. 1, 2009

(54) HEARING AID ADJUSTING APPARATUS, HEARING AID, AND PROGRAM

(75) Inventors: Yosuke Aida, Saitama (JP); Hiroshi Kondo, Kanagawa (JP); Shigekiyo Fujii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/240,103

(22) Filed: Sep. 29, 2008

(65) Prior Publication Data

US 2009/0185703 A1 Jul. 23, 2009

Related U.S. Application Data

(63) Continuation of application No. PCT/JP2008/050721, filed on Jan. 21, 2008.

(51) Int. Cl.
*H04R 25/00* (2006.01)

(52) U.S. Cl. ..... 381/60; 381/314

(58) Field of Classification Search ..... 381/60, 381/312, 314, 328

See application file for complete search history.

(56) References Cited

U.S. PATENT DOCUMENTS

| | | | |
|---|---|---|---|
| 5,202,927 | A | 4/1993 | Topholm |
| 7,020,296 | B2 | 3/2006 | Niederdrank |
| 2003/0112988 | A1 | 6/2003 | Naylor |
| 2004/0190738 | A1 | 9/2004 | Meier et al. |
| 2004/0240693 | A1 | 12/2004 | Rosenthal |
| 2006/0098831 | A1* | 5/2006 | Kaiser et al. ..... 381/312 |

FOREIGN PATENT DOCUMENTS

| | | | |
|---|---|---|---|
| DE | 3900588 | C2 | 7/1990 |
| DE | 19541648 | A1 | 5/1997 |
| DE | 19815373 | A1 | 10/1999 |
| DE | 10053179 | A1 | 5/2001 |
| DE | 10048354 | A1 | 5/2002 |
| DE | 10147811 | C1 | 6/2003 |
| DE | 60109749 | T2 | 2/2006 |
| EP | 1420611 | A1 | 5/2004 |
| JP | 57-178499 | A | 11/1982 |
| JP | 05-344594 | A | 12/1993 |
| JP | 10-200996 | A | 7/1998 |
| JP | 2001-204098 | | 7/2001 |

(Continued)

OTHER PUBLICATIONS

Office Action issued on Feb. 5, 2009 for the corresponding Danish patent application No. PA2008-01483.

(Continued)

*Primary Examiner*—Brian Ensey
(74) *Attorney, Agent, or Firm*—Panasonic Patent Center; Dhiren Odedra; Kerry Culpepper

(57) ABSTRACT

A hearing aid adjusting apparatus 104 for adjusting a parameter of a hearing aid 101 has an input device 201 for accepting an operation input, a storage 203 for storing the parameter for every predetermined surrounding setting, a controller 202 for controlling the parameter for every surrounding setting, and a display 204 for displaying information about the parameter, and the input device 201 accepts selection of the plural surrounding settings and operates one of the selected surrounding settings, and the controller 202 collectively converts a parameter in the selected surrounding setting based on an operation accepted by the input device 201.

27 Claims, 17 Drawing Sheets

FOREIGN PATENT DOCUMENTS

| | | | |
|---|---|---|---|
| JP | 2002-223500 | A | 8/2002 |
| JP | 2006-067232 | | 3/2006 |
| JP | 2006-121693 | A | 5/2006 |
| JP | 2007-295324 | A | 11/2007 |
| JP | 2007295324 | | 11/2007 |
| KR | 10-2001-0001863 | | 1/2001 |
| KR | 10-2002-0050393 | * | 3/2004 |
| KR | 10-2004-0019147 | | 3/2004 |

OTHER PUBLICATIONS

Office Action issued on Mar. 9, 2009 for the corresponding Korean patent application No. 10-2008-7023539.

Office Action issued on Mar. 19, 2009 for the corresponding German patent application No. 10 2008 049 396.1.

PCT international search report (PCT/ISA/210), Dated May 1, 2008, for PCT Application No. PCT/JP2008/050721.

UK patent office communication, Dated Nov. 13, 2008, for Application No. GB0817800.6.

Decision of Final Rejection for Patent issued on May 21, 2009 for the corresponding Korean patent application No. 10-2008-7023539.

* cited by examiner

HEARING AID ADJUSTING APPARATUS, HEARING AID, AND PROGRAM

CROSS-REFERENCE TO RELATED APPLICATION

The present application is a continuation of International Application No. PCT/JP2008/050721 filed on 21 Jan. 2008, the contents of which are incorporated herein by reference.

TECHNICAL FIELD

The present invention relates to a hearing aid adjusting apparatus, a hearing aid and a program, and particularly to a hearing aid adjusting apparatus having a function of fitting software for adjusting a hearing aid, a hearing aid and a program.

BACKGROUND ART

As an adjusting method by surrounding setting of a conventional hearing aid, a method comprising a storage for storing plural kinds of gain control parameters corresponding to plural kinds of noise levels preset by use surroundings, and a controller for selecting its storage and controlling gain of a gain variable amplifier according to the gain control parameter stored in the storage has been devised (for example, see JP-A-10-200996).

DISCLOSURE OF THE INVENTION

Problems that the Invention is to Solve

In fitting adjustment work, plural parameters are sequentially decided, so that when only the particular parameter can be changed and adjusted, this is efficient. However, in the adjusting method in surrounding setting of the conventional hearing aid, gain or volume is respectively changed every plural ambient surroundings and, for example, replacement of order of plural surrounding settings or a collective change in the plural surrounding settings is not considered. That is, order or setting could be replaced every surrounding setting by an individual operation, but order or setting could not be replaced every surrounding setting by a collective operation. As a result of that, time for setting gain or a parameter was required every time individual setting is made.

Further, in the adjusting method in surrounding setting of the conventional hearing aid, gain or volume is changed every plural ambient surroundings, and a collective volume adjustment in the plural surrounding settings is not considered. That is, volume could be set every surrounding setting by an individual operation, but volume could not be set every surrounding setting by a collective operation. As a result of that, time for setting the particular parameter such as volume was required every time individual setting is made. Further, a volume switch for adjusting volume was disposed in order to individually set the volume, but it also became difficult to equip a small hearing aid attached to an ear hole etc. with the volume switch.

The invention has been implemented in order to solve the circumstances described above and relates to duplication, movement and collective conversion of surrounding setting of fitting software for adjusting a hearing aid, and an object of the invention is to provide a hearing aid adjusting apparatus capable of changing surrounding setting by only depression of a memory switching button of a hearing aid body, a hearing aid and a program.

Further, the invention relates to volume of surrounding setting of fitting software for adjusting a hearing aid, and an object of the invention is to provide a hearing aid adjusting apparatus capable of adjusting volume by only depression of a memory switching button of a hearing aid body, a hearing aid and a program.

Means for Solving the Problems

In order to achieve the objects, a first hearing aid adjusting apparatus of the invention is a hearing aid adjusting apparatus for adjusting a parameter of a hearing aid, and has an input device for accepting an operation input, a storage for storing the parameter every predetermined surrounding setting, a controller for controlling the parameter every the surrounding setting, and a display for displaying information about the parameter, and has a configuration in which the input device accepts selection of the plural surrounding settings and operates one of the selected surrounding settings and the controller collectively converts a parameter in the selected surrounding setting based on an operation accepted by the input device.

By this configuration, in the case of intending to adjust a setting similar to the source setting, each parameter can be duplicated at once without being changed one by one, so that effort of adjustment time can be saved.

Further, a second hearing aid adjusting apparatus of the invention has a configuration in which the input device accepts selection of the plural surrounding settings and parameters in the plural surrounding settings and operates the selected parameter of one of the selected surrounding settings and the controller collectively converts the selected parameter in the selected surrounding setting based on an operation accepted by the input device.

By this configuration, for example, in the case of making the same change as a part of the parameter of source setting, it is effective and duplication can be performed to a part of the parameter at once, so that effort of adjustment time can be saved.

Further, a third hearing aid adjusting apparatus of the invention has a configuration in which the controller duplicates originally operated surrounding setting or a parameter in the originally operated surrounding setting to other surrounding setting different from the originally operated surrounding setting or a parameter in the other surrounding setting based on an operation by the input device.

By this configuration, duplication of exactly the same setting as setting in which duplication wants to be performed can be performed, so that effort of adjustment time can be saved.

Further, a fourth hearing aid adjusting apparatus of the invention has a configuration in which the controller inhibits duplication to a parameter in the other surrounding setting when predetermined data is not set in a parameter in the originally operated surrounding setting.

By this configuration, wear comfort of a hearing aid or sound quality of the hearing aid can be improved more.

Further, a fifth hearing aid adjusting apparatus of the invention has a configuration in which the controller moves originally operated surrounding setting between other two surrounding settings different from the originally operated surrounding setting based on an operation by the input device.

By this configuration, particular surrounding setting can be inserted, exchanged or the order can be replaced preferentially and in the case of use of memory switching of a hearing aid, memory setting with high frequency can easily be first arranged.

Further, a sixth hearing aid adjusting apparatus of the invention has a configuration in which the input device drags the originally operated surrounding setting and drops it to surrounding setting as an operation destination.

By this configuration, duplication of exactly the same setting as setting in which duplication wants to be performed can be performed by dragging and dropping, so that effort of adjustment time can be saved. Further, by dragging and dropping, particular surrounding setting can be inserted, exchanged or the order can be replaced preferentially and in the case of use of memory switching of a hearing aid, memory setting with high frequency can easily be first arranged.

Further, a seventh hearing aid adjusting apparatus of the invention has a configuration in which the display further displays a dialog as to whether or not control by the controller is performed.

By this configuration, the contents set before parameter setting are not lost suddenly and its warning dialog is displayed to an operator of a hearing aid adjusting apparatus and thereby, an opportunity to decide whether or not a set parameter value may be deleted is given and further, for example, by inquiring two respects of performing "duplication" or "movement" of a user by a wizard, surrounding setting can be adjusted at ease.

Further, an eighth hearing aid adjusting apparatus of the invention has a configuration of having a communication device for sending a signal including a parameter every the surrounding setting for storage in memory of the hearing aid.

By this configuration, surroundings (for example, "noisy place" or "on the train") in which a wearer of a hearing aid is often placed are set by a hearing aid adjusting apparatus and memory setting information is sent to a storage of a hearing aid body and thereby, the wearer can switch to these surrounding settings by depression of a memory switching button of the hearing aid body.

Further, a ninth hearing aid adjusting apparatus of the invention has a configuration in which the input device accepts selection of a label for changing predetermined information included in the parameter and the controller collectively changes the predetermined information about all the surrounding settings based on the selection of the label.

By this configuration, predetermined information about each surrounding setting can be changed at once based on standard recommended setting by depression of a predetermined label (for example, a volume button or a moderato button), so that various adjustments can be made by only depression or selection of a memory switching button of a hearing aid body.

Further, a tenth hearing aid adjusting apparatus of the invention has a configuration in which the input device accepts selection of a volume label for changing condition about volume included in the parameter and the controller collectively changes the condition about the volume of all the surrounding settings based on the selection of the volume label.

By this configuration, volume about each surrounding setting can be changed at once based on standard recommended setting by depression of a "volume" button, so that the volume can be adjusted by only depression or selection of a memory switching button of a hearing aid body.

Further, an eleventh hearing aid adjusting apparatus of the invention has a configuration in which the controller duplicates a parameter other than condition about volume of first surrounding setting included in the plural surrounding settings to a parameter other than condition about volume of surrounding setting other than the first surrounding setting.

By this configuration, all the parameters other than volume become equal to recommended setting and only the volume varies, so that the volume can be adjusted by only depression or selection of a memory switching button of a hearing aid body.

Further, a twelfth hearing aid adjusting apparatus of the invention has a configuration in which the controller sets condition about different volume in each surrounding setting based on condition about volume of first surrounding setting included in the plural surrounding settings.

By this configuration, parameters other than volume are duplicated and only the volume is set every memory setting by, for example, the preset difference (for example, setting A=−4 dB, setting B=Vol. of recommended setting, setting C=+4 dB, and setting D=+6 dB), and comfortable sound can be provided by a proper volume distance.

Further, a thirteenth hearing aid adjusting apparatus of the invention has a configuration in which the display further displays a dialog as to whether or not control by the controller is performed.

By this configuration, the contents set before a "volume" button is depressed are not lost suddenly and its warning dialog is displayed to an operator of a hearing aid adjusting apparatus and thereby, an opportunity to decide whether or not a set parameter value may be deleted is given and a function of a volume collective change can be used at ease.

Further, a fourteenth hearing aid adjusting apparatus of the invention has a configuration in which the controller performs modal display on the display at the time of displaying a memory setting screen showing the time of performing control by the controller.

By this configuration, a mismatch with a parameter of a memory setting screen in operation can be prevented by being constructed so that setting of a parameter adjustment screen present in the back side of the memory setting screen cannot be operated.

Further, a first hearing aid of the invention has a configuration of having a communication device for receiving a signal including a parameter every predetermined surrounding setting from a hearing aid adjusting apparatus for adjusting the hearing aid, a storage for storing the parameter every the predetermined surrounding setting, and a memory switching device for switching the plural surrounding settings.

By this configuration, a memory switching function normally used in use of switching memory every surrounding setting by situations such as "noisy place", "on the train", "television and music" or "telephone" duplicates each surrounding setting other than volume based on, for example, recommended setting and thereby, only the volume is changed in each surrounding setting, so that, for example, a memory switching button can be used as use of a volume switching button and convenience of a wearer can be improved.

Further, a second hearing aid of the invention has a configuration of having a notification device for providing notification to the effect that switching is performed when surrounding setting is switched by the memory switching device.

By this configuration, a user of a hearing aid can know timing of the memory switching.

Further, a first program of the invention is a program for allowing a computer to function as each means of the hearing aid adjusting apparatus described above.

By this program, for example, in the case of intending to be adjusted to setting similar to source setting, each parameter can be duplicated at once without being changed one by one, so that effort of adjustment time can be saved. Then, it is the program, so that a part or all of the hearing aid adjusting apparatus of the invention can easily be implemented using a general-purpose computer or a server. Further, installation work or distribution of a program can simply be performed by delivering the program using a communication line or being stored in a storage medium.

Effect of the Invention

In the invention, by operating one of plural surrounding settings selected, all the parameters selected can be collectively converted by interlock, so that in the case of intending to be adjusted to setting similar to source setting, each parameter can be duplicated at once without being changed one by one, so that the invention can provide a hearing aid adjusting apparatus having an effect of saving effort of adjustment time, a hearing aid and a program.

Further, the invention comprises a controller for controlling a parameter such as gain or volume every surrounding setting and memory can be stored in a hearing aid every plural surrounding settings, so that a parameter other than the volume is duplicated in a storage to other plural surrounding settings based on standard recommended setting in the controller and thereby, a memory switching device of the hearing aid can be used as use of a volume switching button by changing only the volume in each of the surrounding settings, so that the invention can provide a hearing aid adjusting apparatus having an effect of improving convenience of a wearer, a hearing aid and a program.

Figure 1:
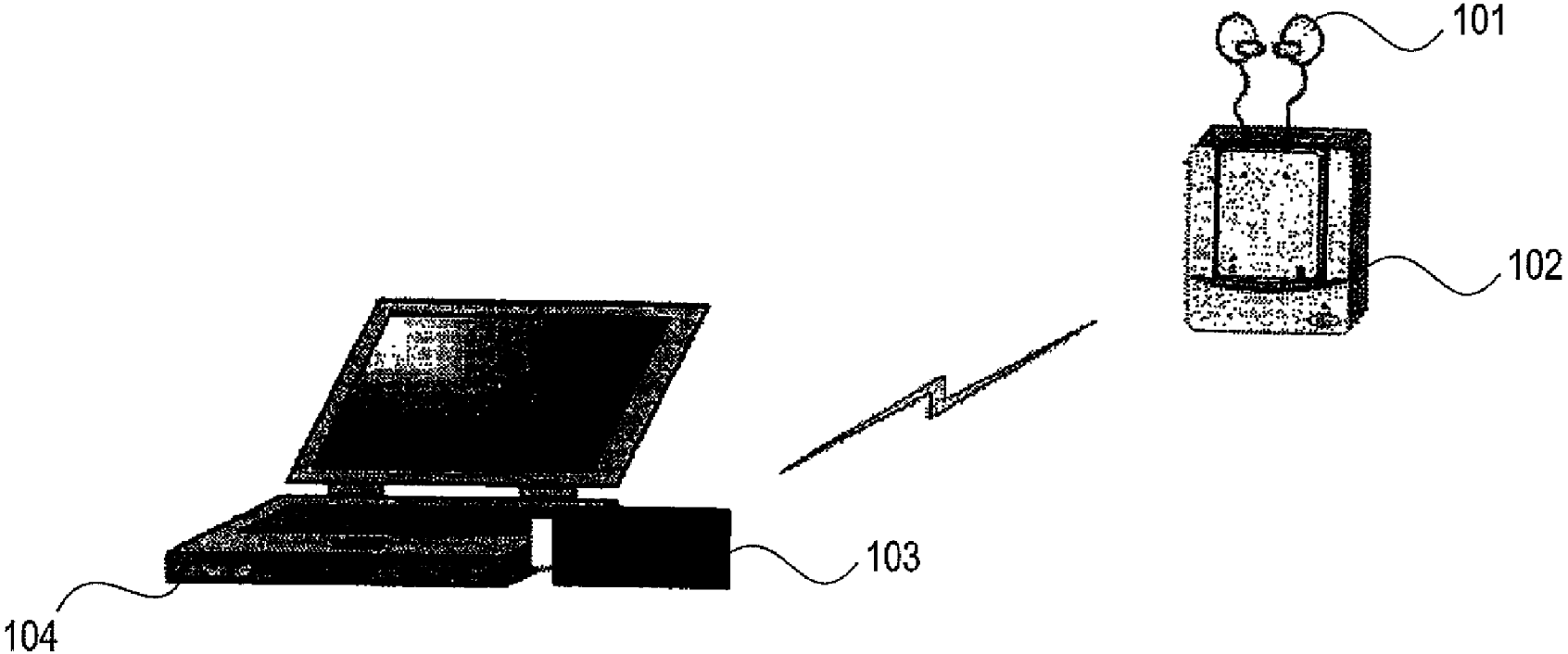
FIG. 1 is a configuration diagram of a hearing aid adjusting system in an embodiment of the invention.

| Description of Reference Numerals and Signs | |
|---|---|
| 101 | HEARING AID |
| 102 | ADJUSTING UNIT |
| 103 | COMMUNICATION UNIT |
| 104 | HEARING AID ADJUSTING APPARATUS |
| 201 | INPUT DEVICE |
| 202 | CONTROLLER |
| 203 | STORAGE |
| 204 | DISPLAY |
| 205 | COMMUNICATION DEVICE |
| 206 | COMMUNICATION DEVICE |
| 207 | CONTROLLER |
| 208 | STORAGE |
| 209 | MEMORY SWITCHING DEVICE |
| 210 | SOUND INPUT-OUTPUT DEVICE |
| 501 | SETTING A |
| 502 | SETTING B |
| 503 | SETTING C |
| 504 | SETTING D |
| 505 | EXTENDED MEMORY |
| 601 | SETTING A |
| 602 | SETTING B |
| 603 | SETTING C |
| 604 | SETTING D |
| 605 | EXTENDED MEMORY |
| 701 | SETTING A |
| 702 | SETTING B |
| 703 | SETTING C |
| 704 | SETTING D |
| 705 | EXTENDED MEMORY |
| 801 | SETTING A |
| 802 | SETTING B |
| 803 | SETTING C |
| 804 | SETTING D |
| 805 | EXTENDED MEMORY |
| 901 | SETTING A |
| 902 | SETTING B |
| 903 | SETTING C |
| 904 | SETTING D |
| 905 | EXTENDED MEMORY |
| 1001 | SETTING A |
| 1002 | SETTING B |
| 1003 | SETTING C |
| 1004 | SETTING D |
| 1005 | EXTENDED MEMORY |
| 1006 | WARNING DIALOG |
| 1007 | DRAG SELECTION STATE SETTING A |
| 1101 | SETTING A |
| 1102 | SETTING B |
| 1103 | SETTING C |
| 1104 | SETTING D |
| 1105 | EXTENDED MEMORY |
| 1201 | SETTING A |
| 1202 | SETTING B |
| 1203 | SETTING C |
| 1204 | SETTING D |
| 1205 | EXTENDED MEMORY |
| 1401 | SETTING A |
| 1402 | SETTING B |
| 1403 | SETTING C |
| 1404 | SETTING D |
| 1405 | EXTENDED MEMORY |
| 1501 | SETTING A |
| 1502 | SETTING B |
| 1503 | SETTING C |
| 1504 | SETTING D |

-continued

| Description of Reference Numerals and Signs | |
|---|---|
| 1505 | EXTENDED MEMORY |
| 1506 | WARNING DIALOG |
| 1601 | SETTING A |
| 1602 | SETTING B |
| 1603 | SETTING C |
| 1604 | SETTING D |
| 1605 | EXTENDED MEMORY |

BEST MODE FOR CARRYING OUT THE INVENTION

A hearing aid adjusting apparatus, a hearing aid and a program of embodiments of the invention will hereinafter be described in detail with reference to the drawings. In addition, the invention is not limited to the following embodiments. Further, in the following embodiments, parameters of surrounding setting will be mainly described, but hearing characteristics of a hearing-impaired person may be considered as the parameters.

FIRST EMBODIMENT

A hearing aid adjusting apparatus according to a first embodiment of the invention will hereinafter be described using the drawings.

FIG. 1 shows a configuration diagram in a hearing aid adjustment of the first embodiment of the invention.

In FIG. 1, numeral 101 is a hearing aid, and numeral 102 is an adjusting unit, and numeral 103 is a communication unit, and numeral 104 is a hearing aid adjusting apparatus, and these are a configuration diagram of a hearing aid adjusting system.

The hearing aid 101 is a digital hearing aid capable of being adjusted by a personal computer etc. Numeral 102 is the adjusting unit, and can be connected to one ear or both ears of the hearing aid 101 and comprises a communication function and can send and receive data to and from the communication unit 103 by USB connection, Bluetooth communication, etc. The hearing aid adjusting apparatus 104 connected to the communication unit 103 is an apparatus mainly comprising an input device, a storage or a display of a portable terminal such as a PDA or a personal computer, and comprises application software for adjusting the hearing aid and can adjust the hearing aid 101 by a communication device etc.

In addition, it is preferable to adjust surrounding setting, gain, volume, etc. of the hearing aid 101 in a state in which a user of the hearing aid 101 attaches the hearing aid to an ear. The hearing aid adjusting apparatus 104 and the hearing aid 101 make a hearing aid adjustment by wireless communication through the adjusting unit 102 and thereby, for example, the hearing aid adjustment can be made with an adjuster and the user of the hearing aid 101 facing mutually, and convenience of both the adjuster and the user of the hearing aid 101 improves.

Figure 2:
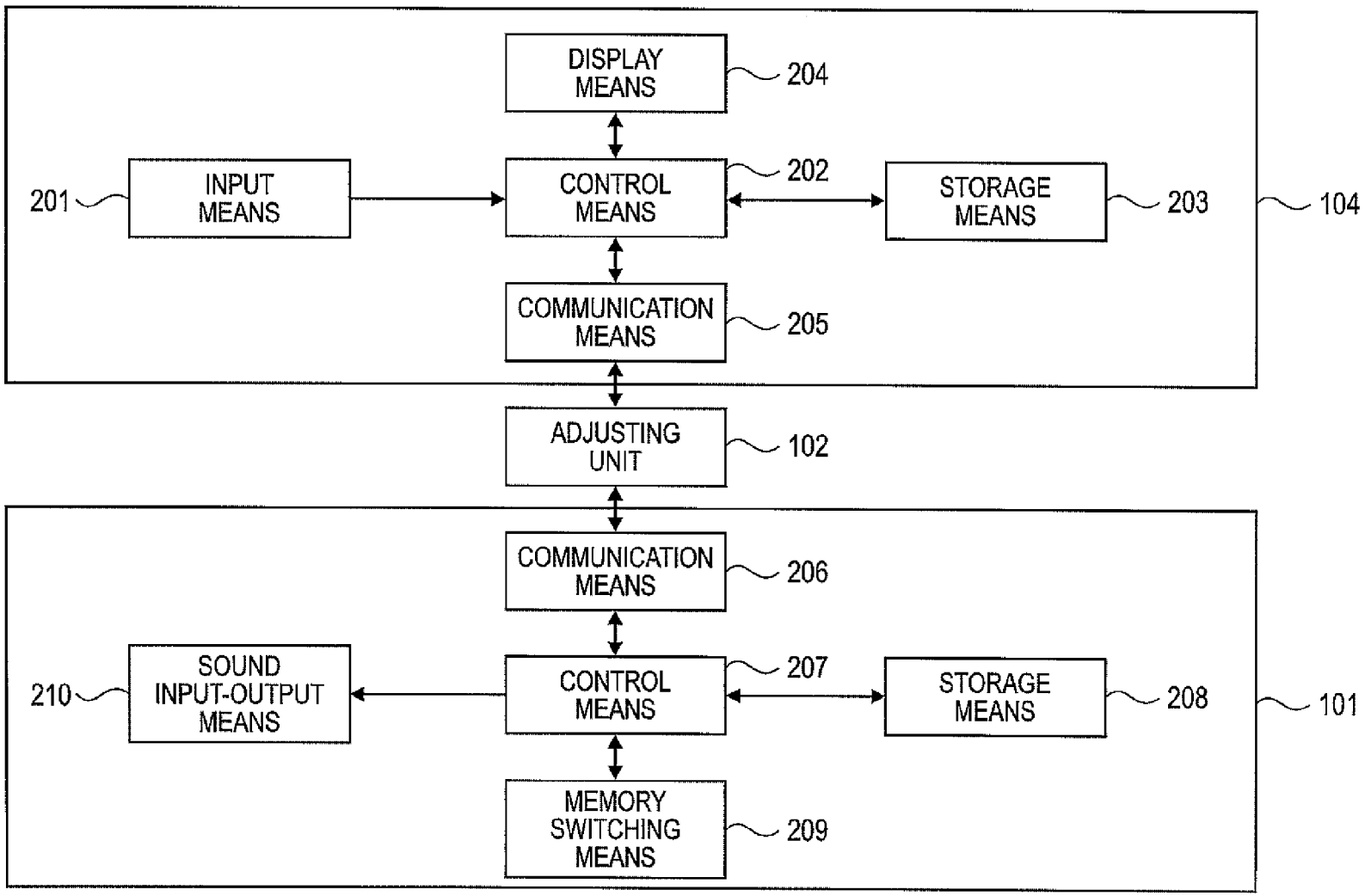
FIG. 2 is a block diagram of a hearing aid adjusting apparatus in the embodiment of the invention.

FIG. 2 is a block diagram showing one example of a configuration of the hearing aid adjusting apparatus according to the embodiment of the invention. Outlines of respective functions will hereinafter be described.

The hearing aid adjusting apparatus 104 for adjusting the hearing aid 101 is configured to have an input device 201, a controller 202, a storage 203, a display 204 and a communication device 205.

The input device 201 is, for example, a mouse or a keyboard in a personal computer, and can input a character or a command of a click etc. of the mouse. As described above, the application software for adjusting the hearing aid is installed on the hearing aid adjusting apparatus 104 and a menu of applications has contents of a hearing input function, an adjustment function of the hearing aid, customer management, etc. including contents for previewing the hearing aid, and the hearing aid adjusting apparatus 104 has a structure capable of transition to each screen by operating the input device 201.

In this application, a hearing aid comprising an surrounding setting function to want to be adjusted is selected using the input device 201 and depression of a button having a function of memory setting is detected by the controller 202 and thereby, the controller 202 starts a screen for setting each of the surrounding settings. The setting of each of the surrounding settings inputted by the input device 201 is stored by the storage 203 and can be checked through a GUI by the display 204. The setting stored by the storage 203 conducts data communication with a communication device 206 of the hearing aid 101 through the adjusting unit 102 by the communication device 205.

Further, the hearing aid 101 is configured to have the communication device 206, a controller 207, a storage 208, a memory switching device 209 and a sound input-output device 210.

The controller 207 which acquires data from the hearing aid adjusting apparatus 104 through the communication device 206 stores this data in the storage 208. Each of the surrounding settings stored can be switched by the memory switching device 209 and as a result of that, sound set by each of the surrounding settings can be checked by the sound input-output device 210.

Figure 3:
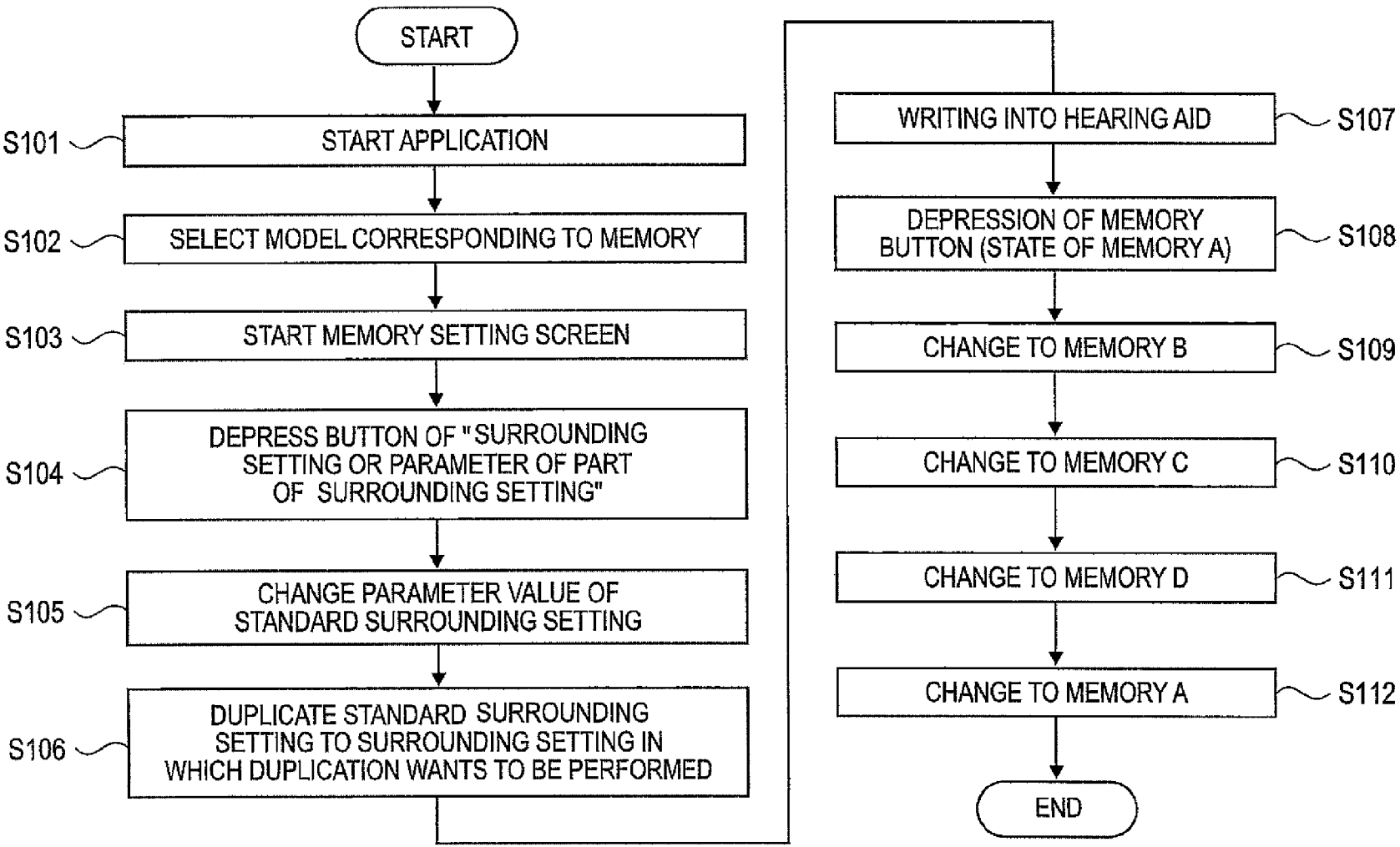
FIG. 3 is an action flowchart of a hearing aid adjusting apparatus in a first embodiment of the invention.

FIG. 3 is a flowchart in control of the hearing aid 101 and the hearing aid adjusting apparatus 104, and one example of an action performed by the configuration of FIG. 2 is shown in a flowchart format. In addition, processing from steps S101 to S106 is performed by the hearing aid adjusting apparatus 104 and processing from steps S107 to S112 is performed by the hearing aid 101.

First, the controller 202 starts an application of hearing aid adjustment software (step S101 of FIG. 3), and accepts selection of a model corresponding to a memory switching function (step S102 of FIG. 3). After the selection, the controller 202 detects depression of a button for making memory setting in order to display a dialog for making memory setting, and starts a memory setting screen (step S103 of FIG. 3).

Figure 5:
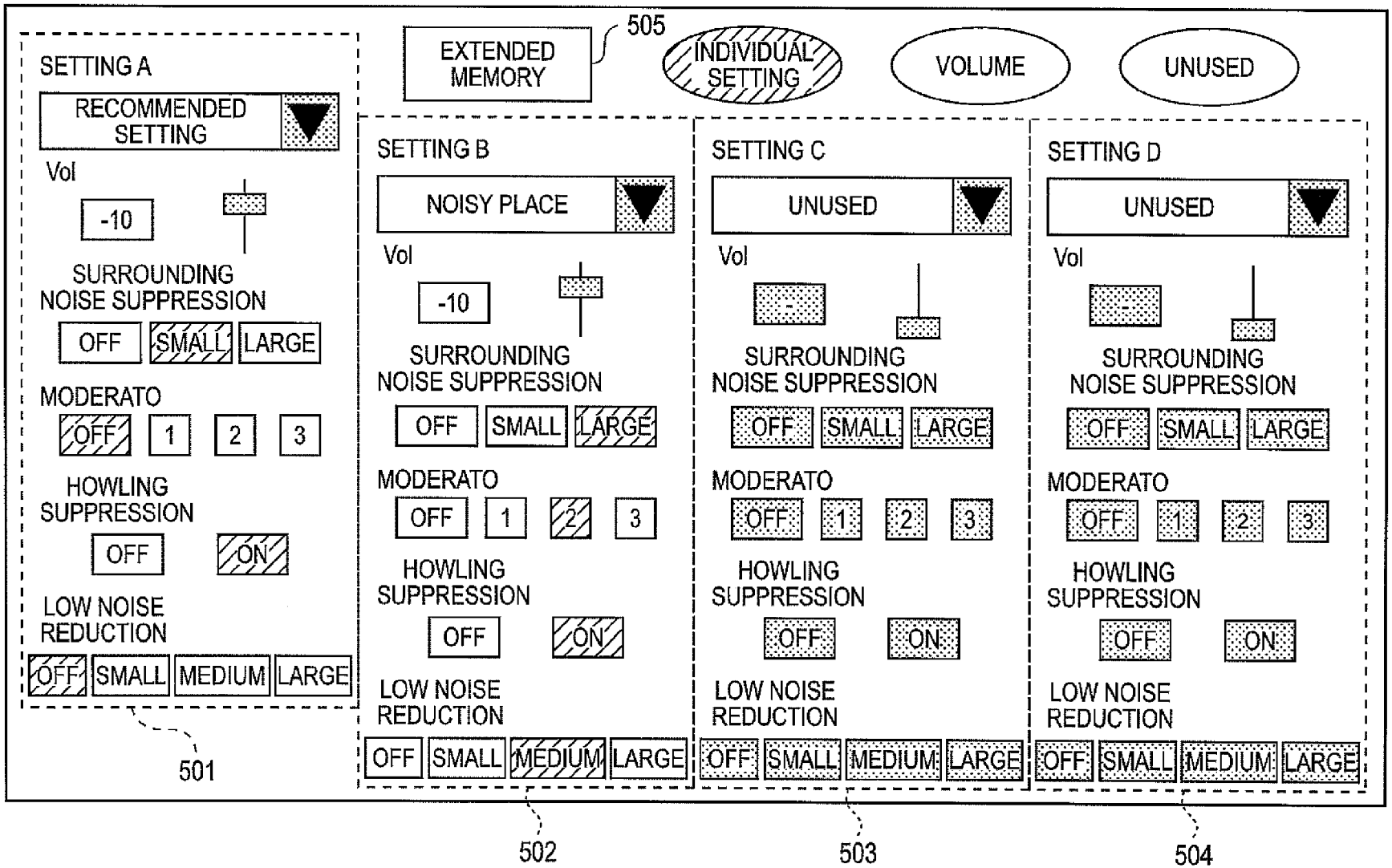
FIG. 5 is a GUI of the hearing aid adjusting apparatus in the first and second embodiments of the invention (at the time of default).

After the memory setting screen is started, the display 204 displays a default screen as shown in FIG. 5. In this case, the controller 202 performs modal display at the time of displaying the memory setting screen and it is constructed so that a parameter adjustment screen present in the back side of the memory setting screen cannot be operated, so that a mismatch with a parameter of the memory setting screen in operation can be prevented. In this memory setting screen, setting A501 is used as standard "recommended setting". A parameter of this setting A501 is based on parameter setting of the previous parameter adjustment screen of the hearing aid adjustment software before this memory setting screen is opened, and its parameter value is duplicated in a place of this setting A501.

As one example, in setting B502, memory effective in listening in a "noisy place" is below preset by default in surrounding setting, and parameters such as volume, gain, surrounding noise suppression, moderato, howling suppression or low noise reduction can be changed as necessary. Further, in setting C503 and setting D504, surrounding setting is not set and the settings are represented by "unused" etc. and are in an inactive state in which an input cannot be operated by the input device 201. Since these are one example, the number of memories capable of memory setting is four this time or may be three or five.

Next, a function of "extended memory" will be described.

As shown in FIG. 5, a memory setting screen includes an "extended memory" label and three buttons of "individual setting", "volume" and "unused" are prepared for the "extended memory" label and herein, these buttons are collectively called an extended memory selection 505. A default is in a state of depressing the "individual setting" button as shown in FIG. 5 and as necessary, the input device 201 depresses the "unused" button in which all the surrounding settings other than the setting A are not used or the "volume" button for changing volume collectively and thereby, the controller 202 can detect the depression. Further, the input device 201 makes a pull-down selection from a state of "unused" of the setting D504 or the setting C503 and the controller 202 can switch to other surrounding setting. Various surrounding settings such as "on the train", "party (banquet)", "television and music", "telephone" and "quiet place" in addition to "recommended setting" and "noisy place" are prepared in the surrounding settings. The input device 201 accepts selection of these surroundings from among the pull-down in the case of listening in a place near to these settings and thereby, proper sound according to its surrounding is enabled.

Then, a duplication method of surrounding setting will be described.

Figure 6:
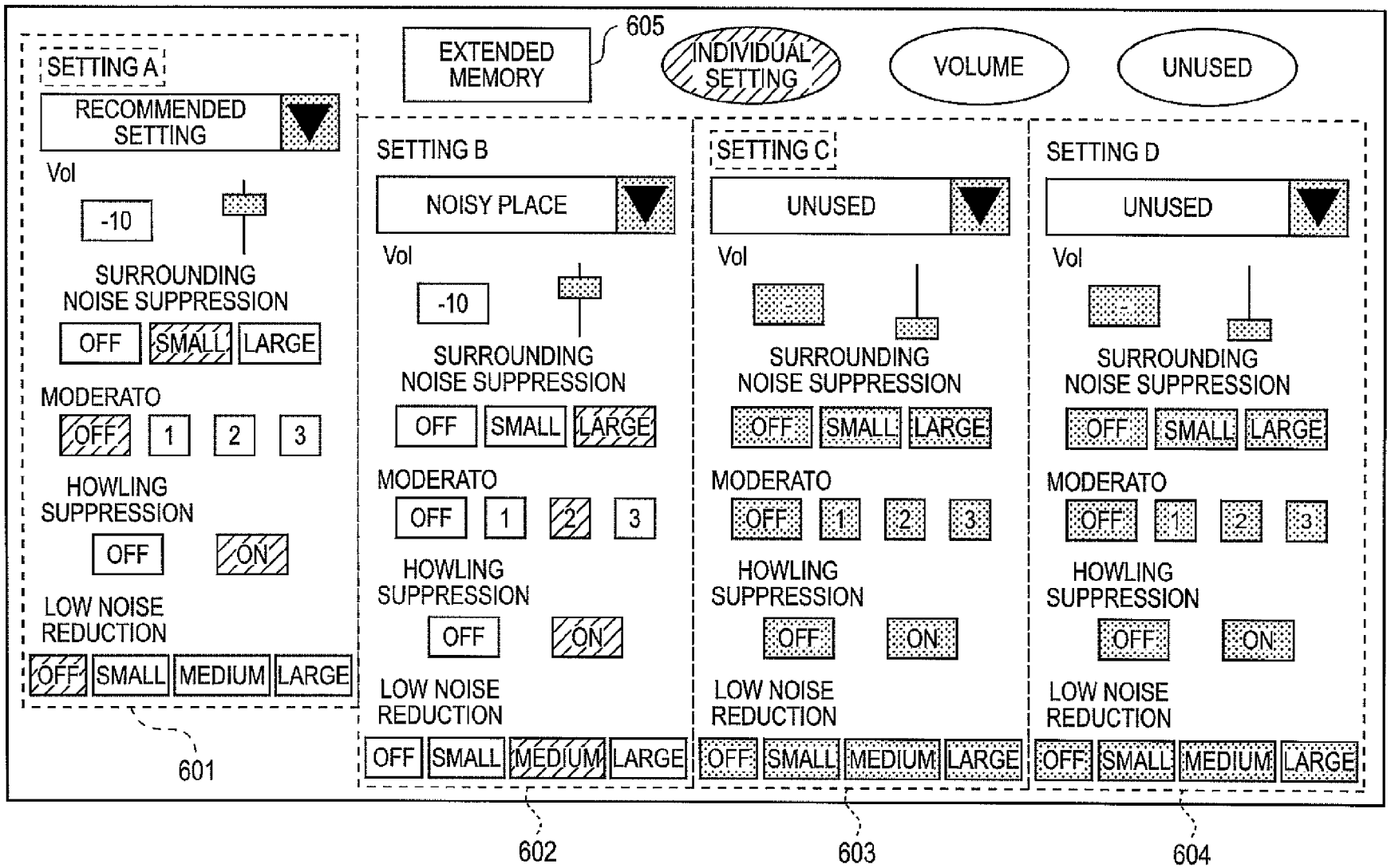
FIG. 6 is a GUI of the hearing aid adjusting apparatus in the first embodiment of the invention (at the time of selecting surrounding setting).
Figure 7:
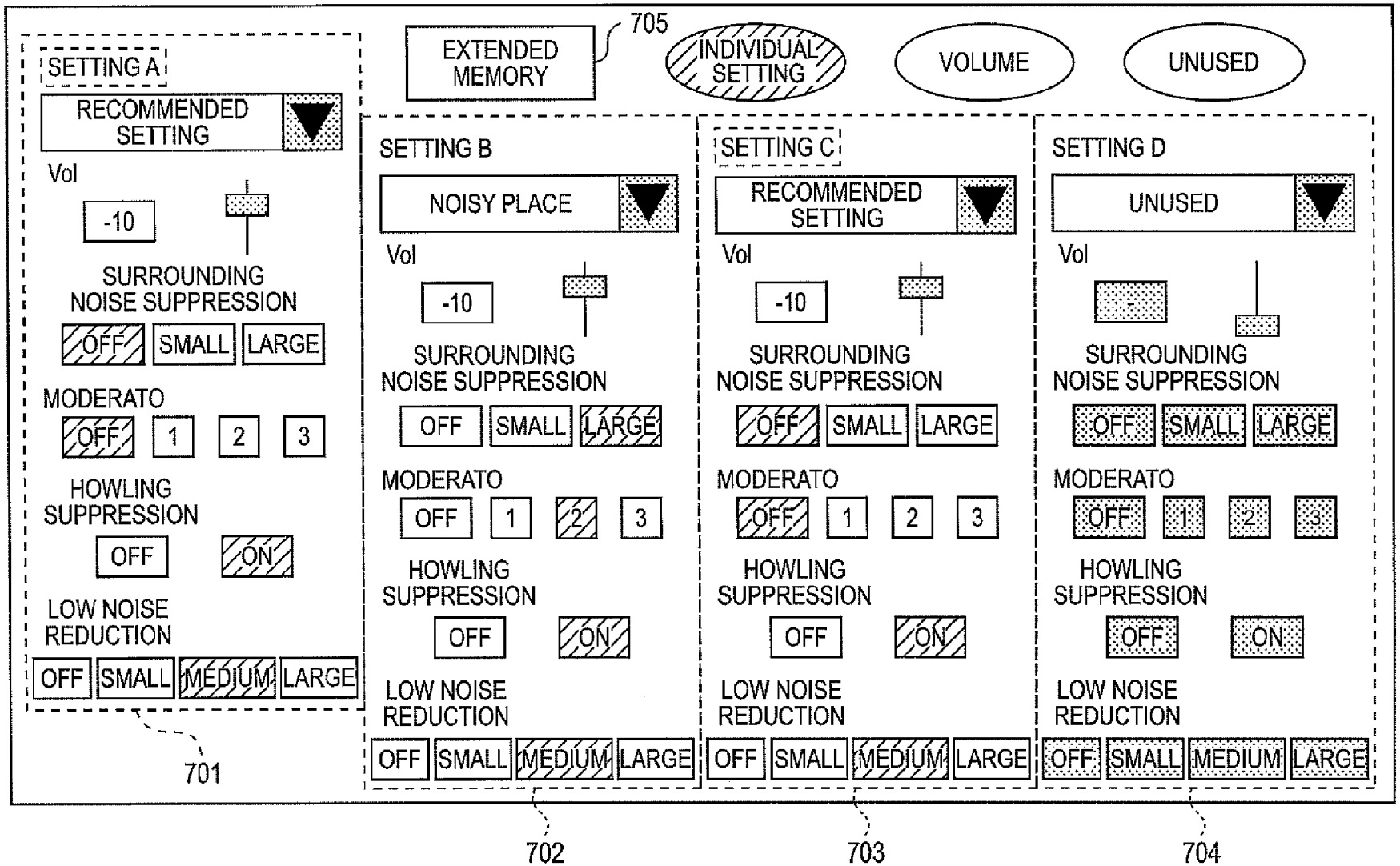
FIG. 7 is a GUI of the hearing aid adjusting apparatus in the first embodiment of the invention (after duplicating surrounding setting).

As shown in FIG. 6, the input device 201 depresses a label of setting ○ (here, "setting A") of surrounding setting used as a duplication source and further, depresses a label of setting Δ (here, "setting C") of a duplication destination at which duplication wants to be performed (step S104 of FIG. 3). After these depressions are detected, the controller 202 changes the surrounding setting of the duplication source setting A (step S105 of FIG. 3) and duplicates all the parameters of the setting A as the setting C (step S106 of FIG. 3). Consequently, the setting C becomes the same setting as the setting A as shown in FIG. 7. The method for duplicating the setting A of the duplication source to the setting C of the duplication destination is herein described, but the duplication destination may be two or three as well as one of the setting C.

Thereafter, the communication device 205 writes into the hearing aid 101 through the adjusting unit 102 (step S107 of FIG. 3) and stores each memory data in the side of the hearing aid 101. Memory setting of the hearing aid 101 is made in a state of memory A as default by the memory switching device 209. Then, by depression of a memory switching button by input device (not shown) (step S108 of FIG. 3), a change from the state of memory A as default to memory B is made by the memory switching device 209 (S109 of FIG. 3) and by depression of the memory switching button by the input device (not shown) again, a change to memory C is made by the memory switching device 209 (S110 of FIG. 3) and by depression of the memory switching button by the input device (not shown) again, a change to memory D is made by the memory switching device 209 (step S111 of FIG. 3). Further, when the memory switching button is depressed by the input device (not shown) again from the memory D, a change to the memory A is made by the memory switching device 209 (S112 of FIG. 3). In addition, the memory switching (change) is optional.

In addition, the memories A to D show, for example, memory regions in the storage 208 of the hearing aid 201 and, for example, information about parameters of setting A to setting D is stored in the memory A to the memory D.

In addition, in the case of performing memory switching by the memory switching device 209, it may be constructed so as to provide notification to the effect that the memory switching is performed by a notification device (not shown).

By the above, parameters of certain surrounding setting can be converted at once and collective duplication of the parameters can be performed easily.

In the above-mentioned example, the technique for duplicating all the parameters of the surrounding setting itself has been described, but there is a method for duplicating only a particular parameter as another duplication method, so that the description will hereinafter be made.

Figure 8:
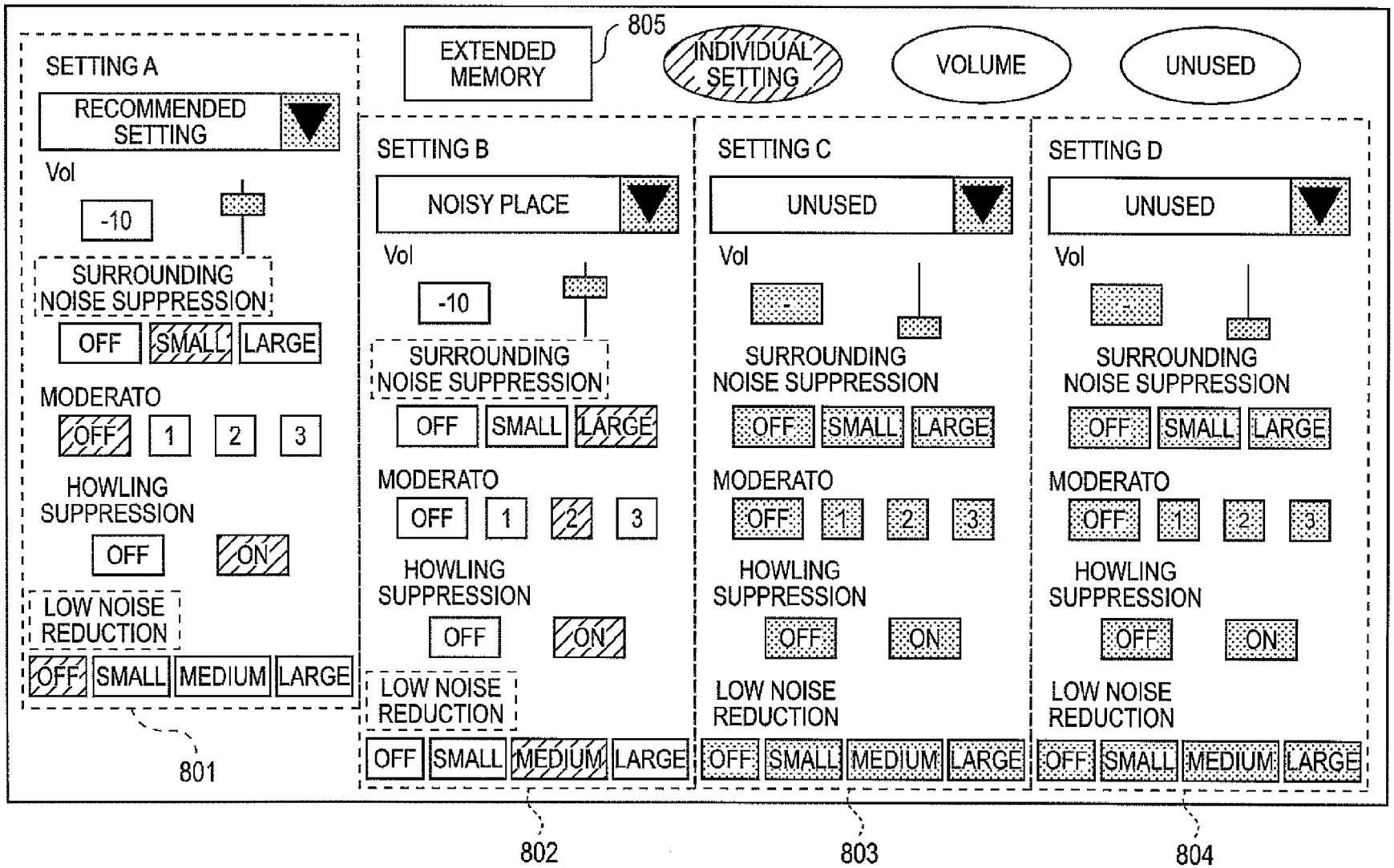
FIG. 8 is a GUI of the hearing aid adjusting apparatus in the first embodiment of the invention (at the time of selecting a part of a parameter of surrounding setting).
Figure 9:
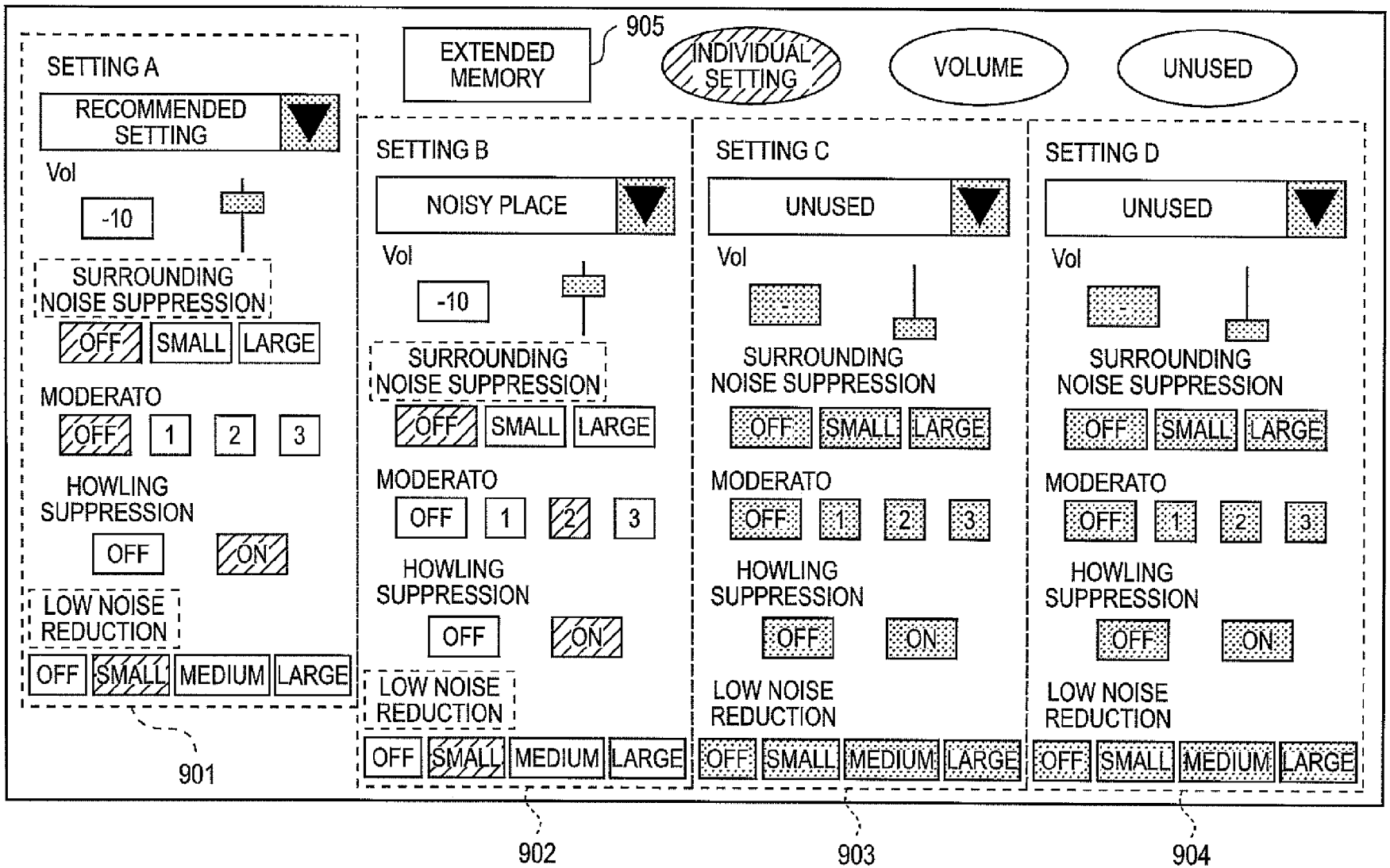
FIG. 9 is a GUI of the hearing aid adjusting apparatus in the first embodiment of the invention (after duplicating a part of a parameter of surrounding setting).

The method is basically the same as the collective parameter change every surrounding setting described above and here, as shown in FIG. 8, plural labels (here, surrounding noise suppression and low noise reduction) in which duplication wants to be performed or one label of a particular parameter of setting ○ (here, "setting A") of surrounding setting used as a duplication source are depressed and selected using the input device 201. Further, the same parameter label as that of a duplication source of setting Δ (here, "setting B") of a duplication destination at which duplication wants to be performed is selected using the input device 201 and its label is depressed (step S104 of FIG. 3). After these selections or depressions are detected by the controller 202, when the surrounding setting of the parameter of a part of the duplication source setting A is changed by the controller 202 (step S105 of FIG. 3), the setting B duplicates the parameter of a part of the setting A by the controller 202 (step S106 of FIG. 3), and becomes the same setting as the setting A as shown in FIG. 9. The method for duplicating the setting A of the duplication source to the setting B of the duplication destination is herein described, but the duplication destination may be two or three as well as one of the setting B. Thereafter, in a manner similar to the above, writing into the hearing aid 101 is performed (step S107 of FIG. 3) and each memory data is stored in the side of the hearing aid 101. Memory setting of the hearing aid 101 is made in a state of memory A as default. Then, by depression of a memory switching button (step S108 of FIG. 3), a change from the state of memory A as default to memory B is made (step S109 of FIG. 3) and by depression of the memory switching button again, a change to memory C is made (step S110 of FIG. 3) and by depression of the memory switching button again, a change to memory D is made (step S111 of FIG. 3). Further, when the memory switching button is depressed again from the memory D, a change to the memory A is made (step S112 of FIG. 3). In addition, the memory switching (change) is optional.

In addition, description of the subject is herein omitted, but in a manner similar to the above, in the case of performing memory switching (change) by the memory switching device 209, it may be constructed so as to provide notification to the effect that the memory switching is performed by a notification device (not shown).

By the above, parameters of a part of certain surrounding setting can be converted at once and collective duplication of a part of the parameters can be performed easily.

In addition, basically, a part or all of the setting parameters can be duplicated from setting A to setting B, C or D, or from setting B to setting A, C or D, and when a duplication source is in a state of "unset" (that is, predetermined data is not set as a parameter of surrounding setting of the duplication source) and a duplication destination is the setting A, the controller 202 can inhibit this duplication. For example, from a state of FIG. 5, duplication of the setting C to the setting A can be inhibited. Consequently, wear comfort of a hearing aid or sound quality of the hearing aid can be improved more.

According to such a hearing aid adjusting apparatus 104 of the first embodiment of the invention, the hearing aid adjusting apparatus has the input device 201 for accepting an operation input, the storage 203 for storing a parameter every predetermined surrounding setting, the controller 202 for controlling the parameter every the surrounding setting, and the display 204 for displaying information about the parameter, and the input device 201 accepts selection of the plural surrounding settings and operates one of the selected surrounding settings, and the controller 202 can collectively convert a parameter in the selected surrounding setting based on an operation accepts by the input device 201, so that the surrounding setting itself or a parameter of a part of the surrounding setting can be duplicated to other plural surrounding settings based on standard recommended setting in the controller 202.

SECOND EMBODIMENT

A block diagram and a configuration diagram in a hearing aid adjustment of a second embodiment of the invention are similar to those of the first embodiment of the invention.

The change respects are in a duplication method and a movement method.

Figure 4:
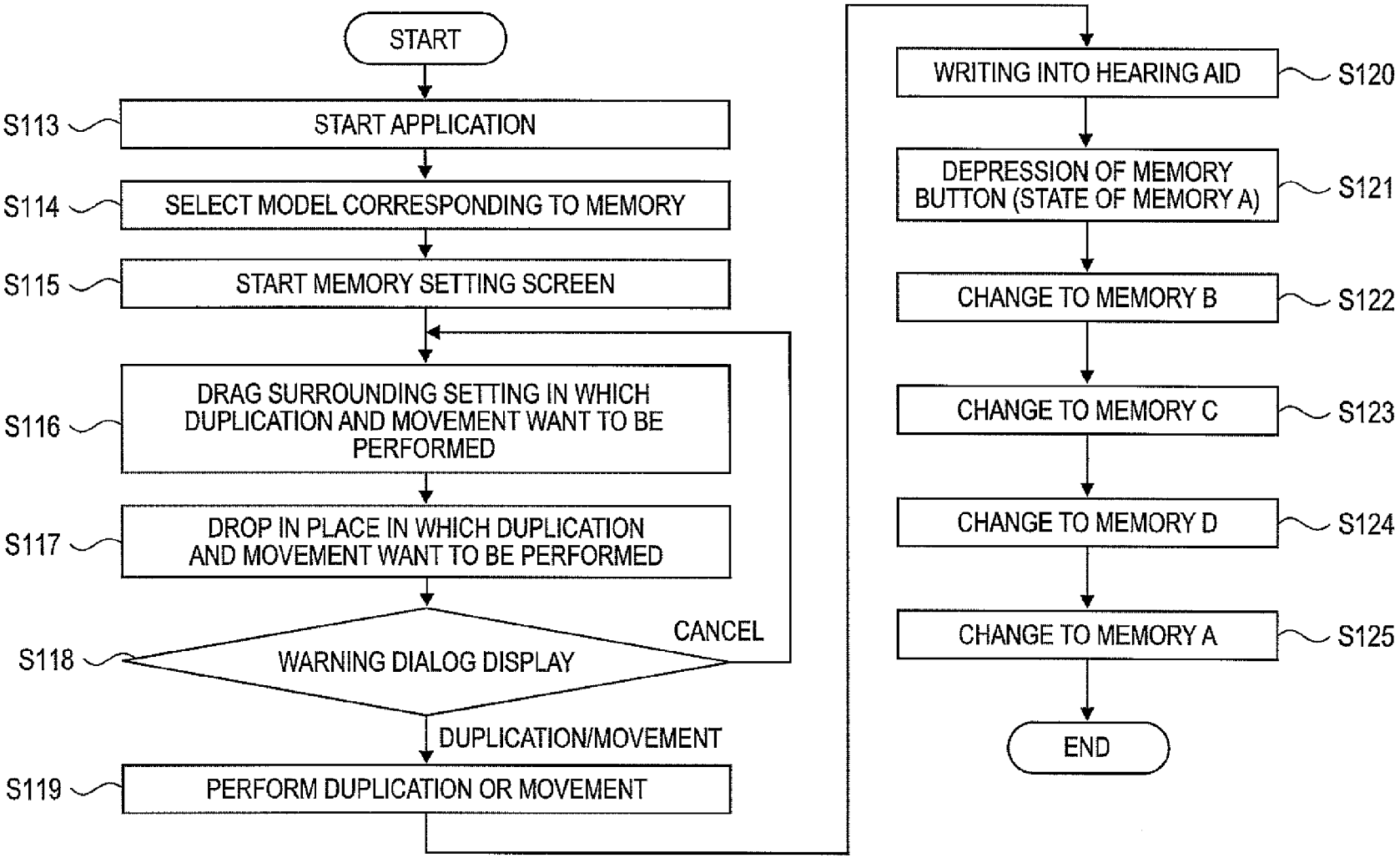
FIG. 4 is an action flowchart of a hearing aid adjusting apparatus in a second embodiment of the invention.

FIG. 4 is another example of a flowchart in control of a hearing aid 101 and a hearing aid adjusting apparatus 104, and one example of an action performed by the configuration of FIG. 2 is shown in a flowchart format. In addition, processing from steps S113 to S119 is performed by the hearing aid adjusting apparatus 104 and processing from steps S120 to S125 is performed by the hearing aid 101.

First, a controller 202 starts an application of hearing aid adjustment software (step S113 of FIG. 4), and accepts selection of a model corresponding to a memory switching function (step S114 of FIG. 4). After the selection, the controller 202 detects depression of a button for making memory setting in order to display a dialog for making memory setting, and starts a memory setting screen (step S115 of FIG. 4).

Then, from a state of FIG. 5 of default, an input device 201 drags a label of setting ○ (here, "setting A") of surrounding setting used as a duplication source and a movement source (step S116 of FIG. 4) and further, drops into a label of setting Δ (here, "setting C") of a duplication destination and a movement destination at which duplication and movement want to be performed (step S117 of FIG. 4).

Figure 10:
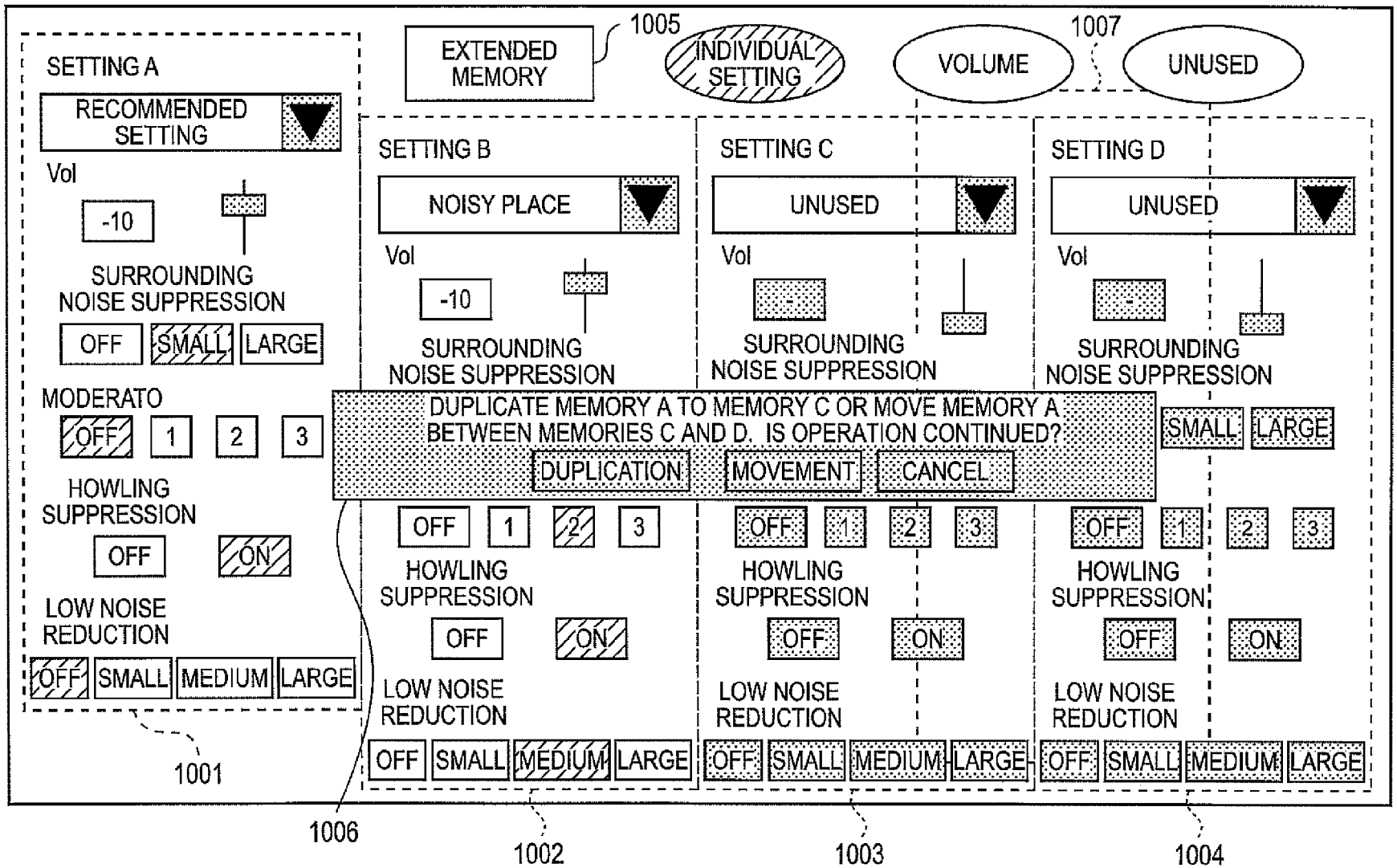
FIG. 10 is a GUI of the hearing aid adjusting apparatus in the second embodiment of the invention (an example at the time of dragging).

Then, as shown in FIG. 10, a warning dialog 1006 is displayed by a display 204 and a selection as to whether to perform duplication or movement is made by instructions of an operator (step S118 of FIG. 4). Here, drag selection state setting A1007 indicating that the setting A is dragged is also displayed by the display 204. In FIG. 10, the contents of the setting A is not illustrated, but each setting information can be moved while being displayed. In addition, the warning dialog can be displayed as necessary in setting work.

Here, when the input device 201 depresses cancel, the controller 202 makes transition to the state before the drag (default state of FIG. 5).

Figure 11:
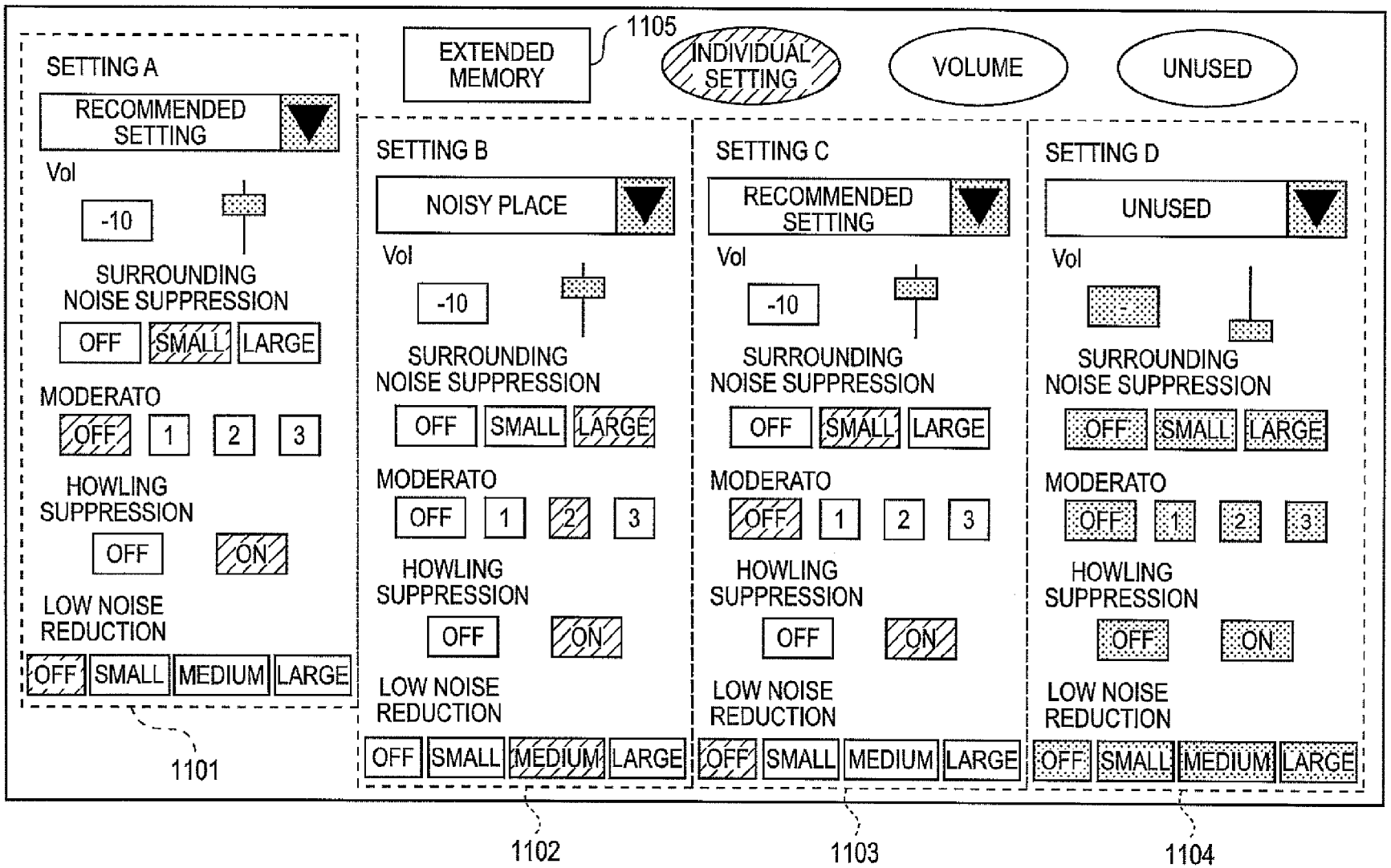
FIG. 11 is a GUI of the hearing aid adjusting apparatus in the second embodiment of the invention (an example of duplication after dragging and dropping).

When "duplication" is depressed, all the surrounding setting parameter information about the setting A is copied to the setting C by the controller 202 and the setting A and the setting C become the same state (step S119 of FIG. 4). FIG. 11 is one example of a display result by the display 204 in this case.

Figure 12:
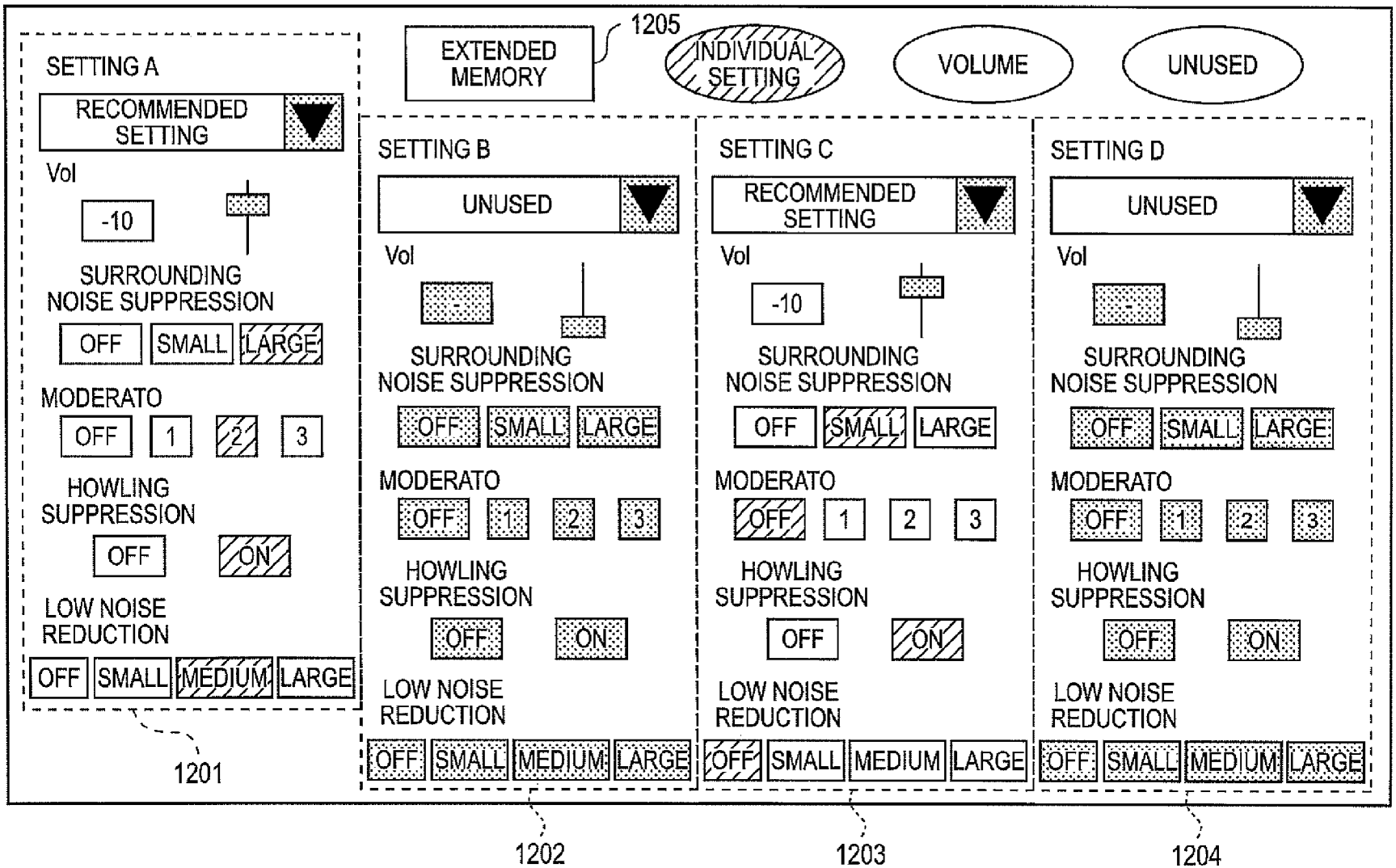
FIG. 12 is a GUI of the hearing aid adjusting apparatus in the second embodiment of the invention (an example of movement after dragging and dropping).

On the other hand, when "movement" is depressed, all the surrounding setting parameter information about the setting A is moved and copied to the setting C by the controller 202 and the setting A before the movement is moved to surrounding setting of setting B (step S119 of FIG. 4). FIG. 12 is one example of a display result by the display 204 in this case. In the case of being moved thus, for example, "recommended setting" of setting A is inserted between setting C and setting D in FIG. 5 and setting B and setting C in FIG. 5 are shifted to the left one by one and order of the setting is sorted.

The behavior of "duplication" and "movement" has been described herein, but a function capable of replacing a parameter value of drag operation start surrounding setting with a parameter value of surrounding setting in the execution of a drop operation by the controller 202 is also contemplated by disposing a function of "exchange" as other function. For example, an exchange between setting A and setting C can be performed from the state of FIG. 5.

Thereafter, in a manner similar to the first embodiment, that is, processing similar to step S107 to step S112 of FIG. 3 is performed. Writing into the hearing aid 101 is performed (step S120 of FIG. 4) and each memory data is stored in the side of the hearing aid 101. Memory setting of the hearing aid 101 is made in a state of memory A as default. Then, by depression of a memory switching button (step S121 of FIG. 4), a change from the state of memory A as default to memory B is made (step S122 of FIG. 4) and by depression of the memory switching button again, a change to memory C is made (step S123 of FIG. 4) and by depression of the memory switching button again, a change to memory D is made (step S124 of FIG. 4). Further, when the memory switching button is depressed again from the memory D, a change to the memory A is made (step S125 of FIG. 4).

In addition, description of the subject is herein omitted, but in a manner similar to the first embodiment, in the case of performing memory switching by memory switching device 209, it may be constructed so as to provide notification to the effect that the memory switching is performed by a notification device (not shown).

In addition, basically, movement, sorting or exchange can be performed in any setting, but when setting A of a movement destination, a sorting destination or an exchange destination becomes "unset" as a result of movement, sorting or exchange, the controller 202 inhibits these actions.

By the above, conversion of a parameter of certain surrounding setting can perform duplication or movement by only an operation of dragging and dropping, and duplication and movement of the parameter can easily be performed.

According to such a hearing aid adjusting apparatus 104 of the second embodiment of the invention, the input device 201 drags originally operated surrounding setting and drops it to surrounding setting as an operation destination, so that duplication can easily be performed in a place in which duplication wants to be performed or movement can easily be performed in a place in which movement wants to be performed, so that in the case of intending to be adjusted to setting similar to standard setting (a duplication source and a movement source), each parameter can be duplicated and moved at once without being changed one by one, so that effort of adjustment time can be saved. Further, erasure of parameter data during setting can be prevented by displaying the warning dialog.

THIRD EMBODIMENT

A block diagram and a configuration diagram in a hearing aid adjustment of a third embodiment of the invention are similar to those of the first embodiment of the invention.

Figure 13:
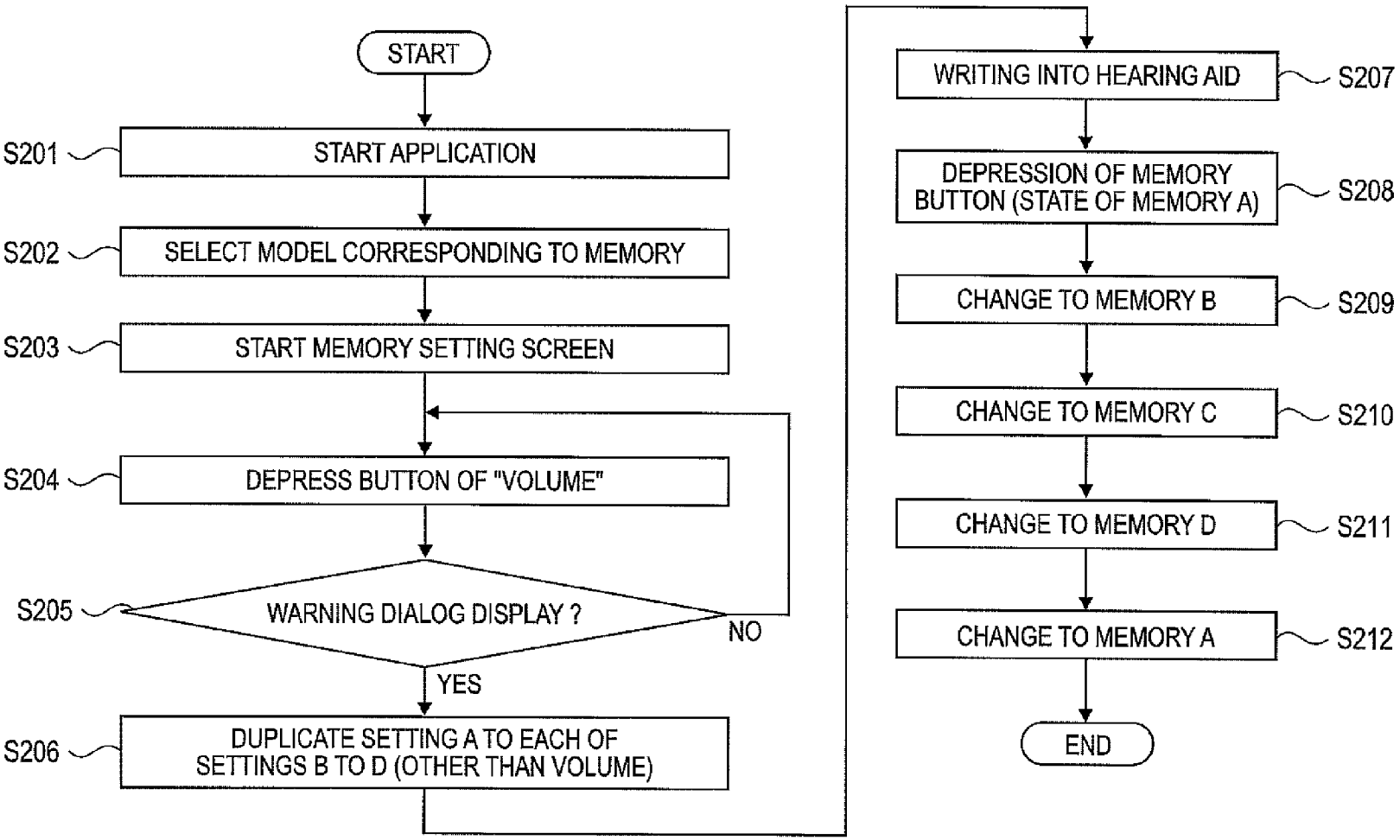
FIG. 13 is an action flowchart of a hearing aid adjusting apparatus in a third embodiment of the invention.

FIG. 13 is a further example of a flowchart in control of a hearing aid 101 and a hearing aid adjusting apparatus 104, and one example of an action performed by the configuration of FIG. 2 is shown in a flowchart format. In addition, processing from steps S201 to S206 is performed by the hearing aid adjusting apparatus 104 and processing from steps S207 to S212 is performed by the hearing aid 101.

First, a controller 202 starts an application of hearing aid adjustment software (step S201 of FIG. 13), and accepts selection of a model corresponding to a memory switching function (step S202 of FIG. 13). After the selection, the controller 202 detects depression of a button for making memory setting in order to display a dialog for making memory setting, and starts a memory setting screen (step S203 of FIG. 13).

Figure 14:
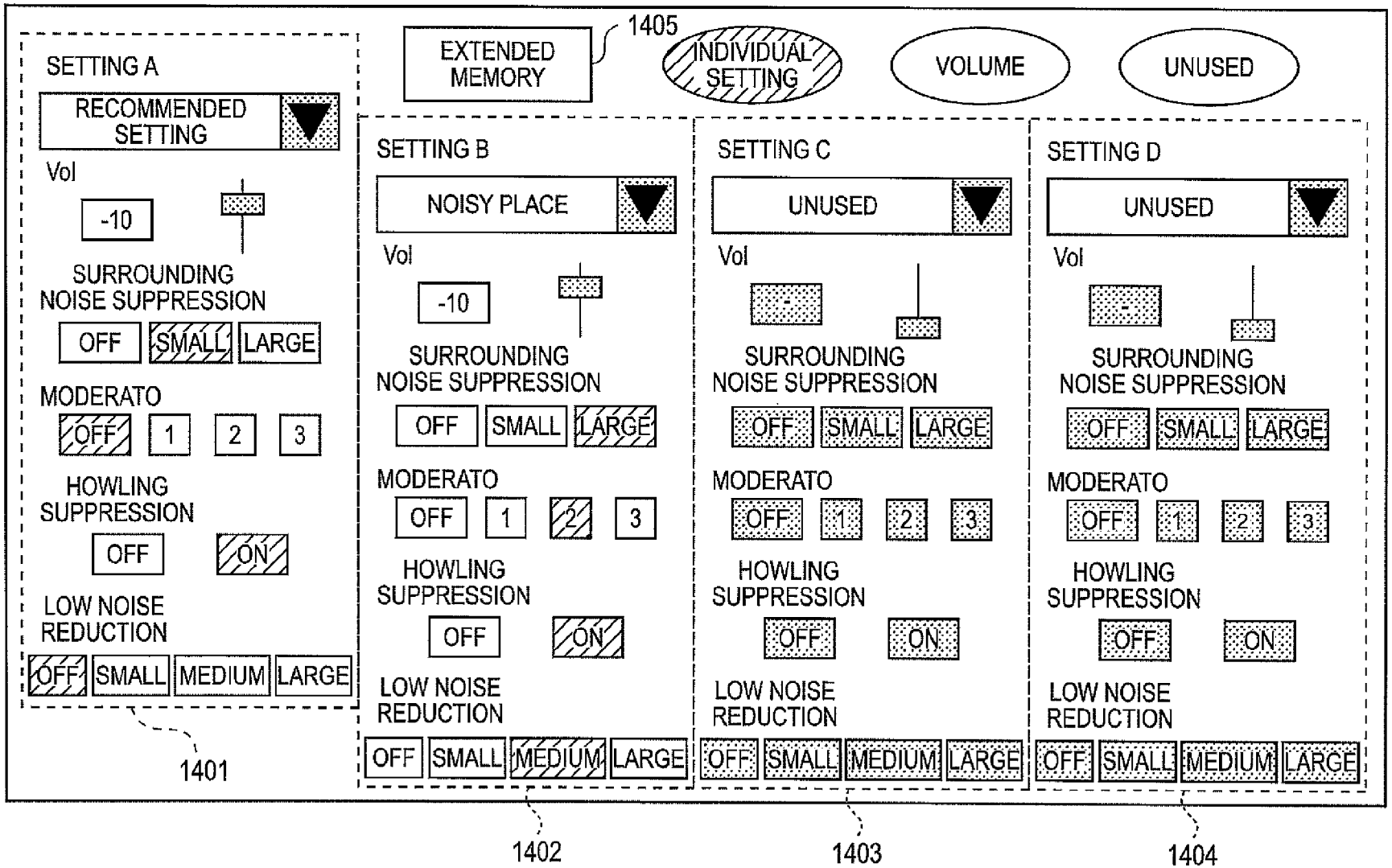
FIG. 14 is a GUI of the hearing aid adjusting apparatus in the third embodiment of the invention (at the time of default).

After the memory setting screen is started, a display 204 displays a default screen as shown in FIG. 14. In this case, the controller 202 performs modal display at the time of displaying the memory setting screen and it is constructed so that adjustment of a parameter adjustment screen present in the back side of the memory setting screen cannot be operated, so that a mismatch with a parameter of the memory setting screen in operation can be prevented. In this memory setting screen, setting A1401 is used as standard "recommended setting". A parameter of this setting A1401 is based on parameter setting of the parameter adjustment screen of the hearing aid adjustment software before this memory setting screen is opened, and its parameter value is duplicated in a place of this setting A1401.

As one example, in setting B1402, memory effective in listening in a "noisy place" is below preset by default in surrounding setting, and parameters such as volume, gain, surrounding noise suppression, moderato, howling suppression or low noise reduction can be changed as necessary.

Further, in setting C1403 and setting D1404, surrounding setting is not set and the settings are represented by "unused" etc. and are in an inactive state in which an input cannot be operated by an input device 201. Since these are one example, the number of memories capable of memory setting is four this time or may be three or five.

Next, a function of "extended memory" will be described.

As shown in FIG. 14, three buttons of "individual setting", "volume" and "unused" are prepared for an "extended memory" label and herein, these buttons are collectively called an extended memory selection 1405. A default is in a state of depressing the "individual setting" button as shown in FIG. 14 and as necessary, the input device 201 depresses the "unused" button or the "volume" button and thereby, the controller 202 can detect the depression. Further, the input device 201 makes a pull-down selection from a state of "unused" of the setting D1404 or the setting C1403 and the controller 202 can switch to other surrounding setting. Various surrounding settings such as "on the train", "party (banquet)", "television and music", "telephone" and "quiet place" in addition to "recommended setting" and "noisy place" are prepared in the surrounding settings. The input device 201 accepts selection of these surroundings from among the pull-down in the case of listening in a place near to these settings and thereby, proper sound according to its surrounding is enabled. In addition, as the "extended memory" label, information (for example, moderato) other than the three buttons may be prepared as a label.

The controller 202 detects depression of the "unused" button of the extended memory 1405 and thereby, the setting B1402 to the setting D1404 become an inactive state and become a state in which other parameters cannot be operated unless surrounding setting is selected by pull-down. Consequently, a memory function can use only the setting A in the side of the hearing aid 101. Further, when any of the surrounding settings of the setting B1402 to the setting D1404 is operated from a state of depression of the "unused" button, the state of depression of the "unused" button is released and depression of the "individual setting" button is detected by the controller 202 and any of the surrounding settings of the setting B1402 to the setting D1404 can be made.

Next, behavior of the "volume" button of the extended memory 1405 will be described.

In the memory setting screen of FIG. 14, the "volume" button of the extended memory 1405 are depressed and selected using the input device 201 (step S204 of FIG. 13).

Figure 15:
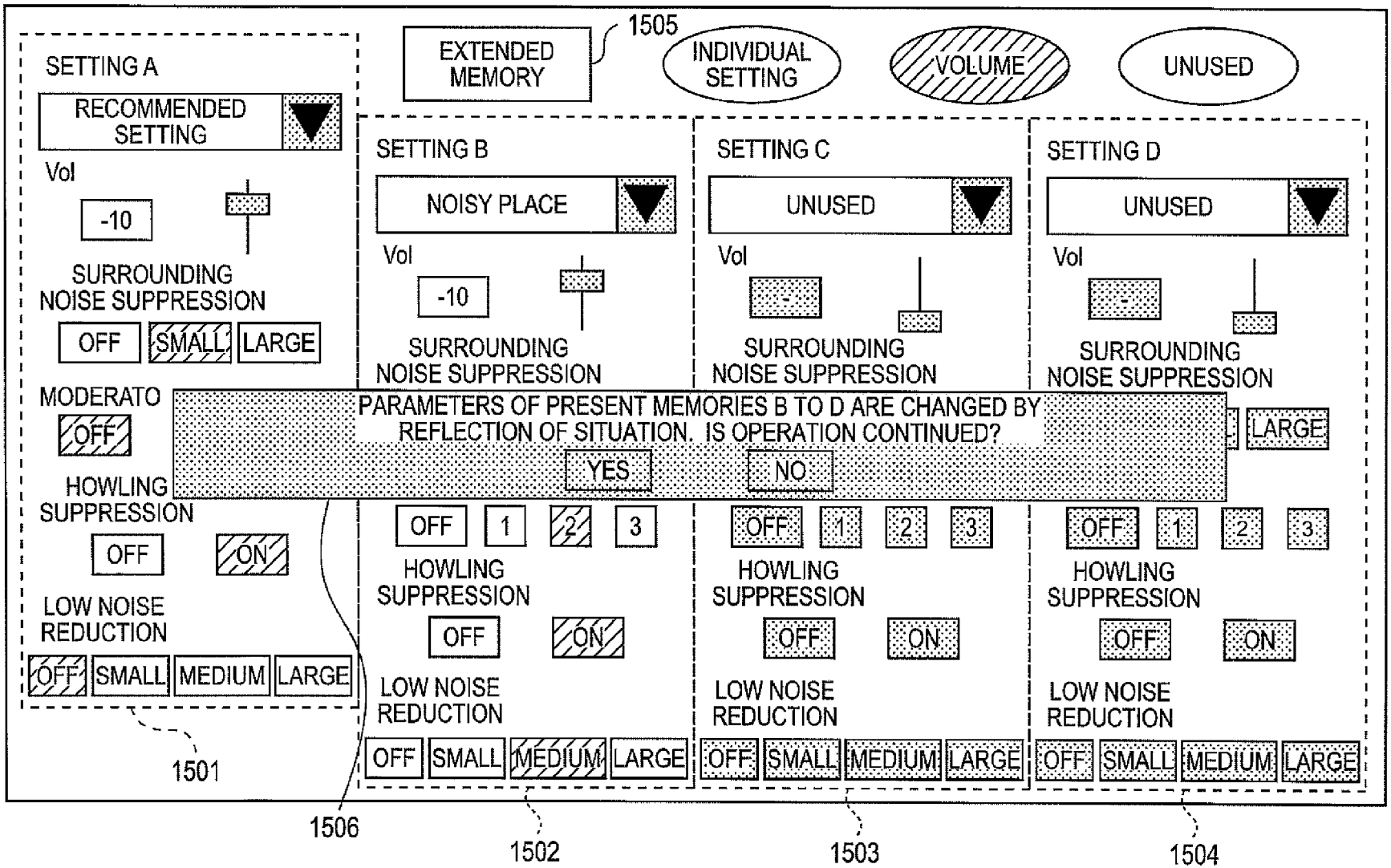
FIG. 15 is a GUI of the hearing aid adjusting apparatus in the third embodiment of the invention (dialog display at the time of depressing a volume button).

Then, there is a possibility that parameter change work was done in setting B1402 to setting D1404 before its depression, so that the controller 202 displays a warning dialog 1506 of FIG. 15 on the display device 204 so as not to erase its parameter setting by mistake (S205 of FIG. 13). When the input device 201 accepts the selection of "no", the screen returns to the state of FIG. 14 before the "volume" button is depressed using the controller 202. Further, when the input device 201 accepts the selection of "yes", all the parameters set in setting A1501 other than the volume are duplicated to setting B1502 to setting D1504 by the controller 202 (S206 of FIG. 13). A state of the case of selecting "yes" is FIG. 16. In addition, the warning dialog can be displayed as necessary in setting work.

Figure 16:
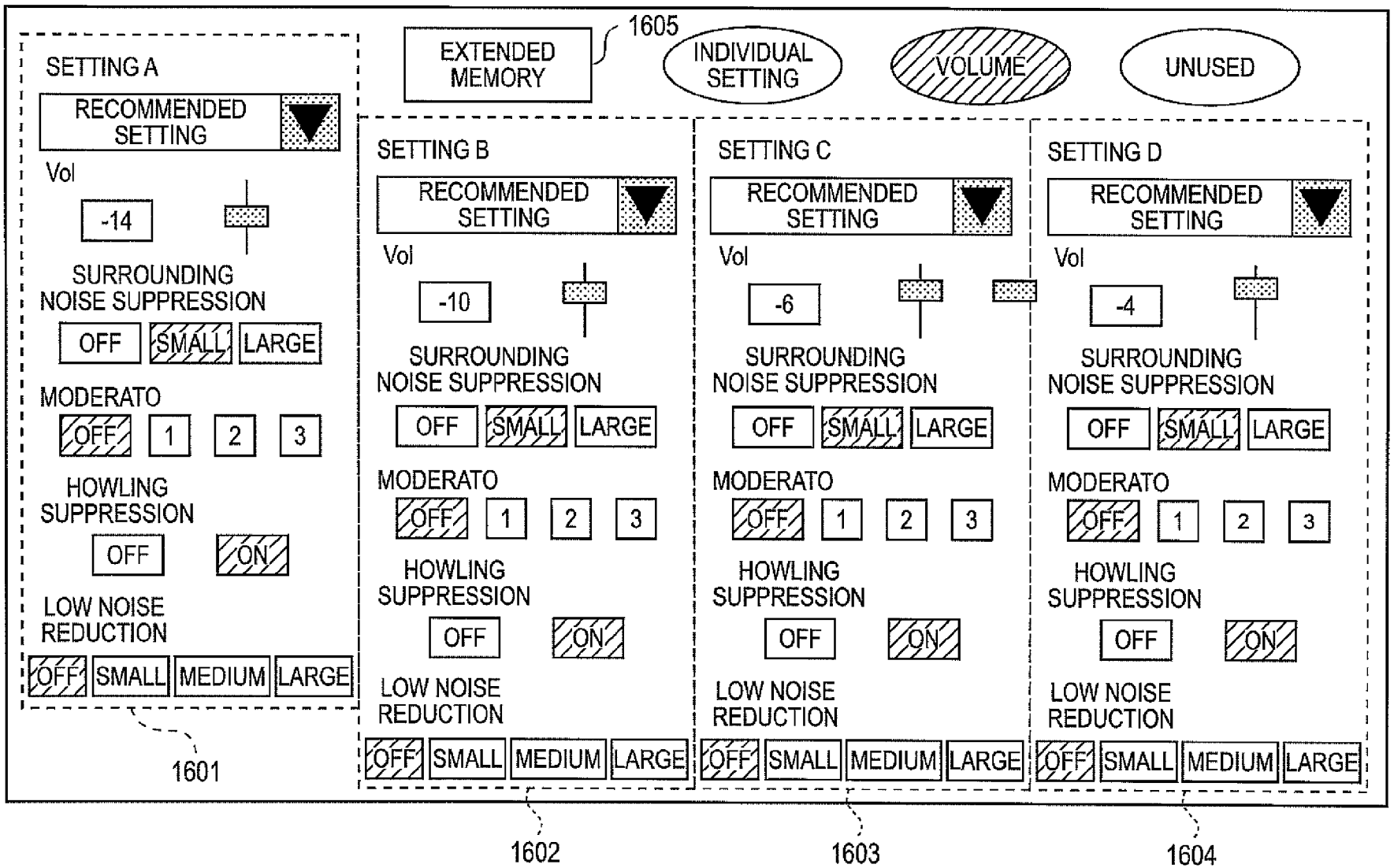
FIG. 16 is a GUI of the hearing aid adjusting apparatus in the third embodiment of the invention (after depressing a volume button).

Here, in only the volume, the controller 202 duplicates a volume value of the setting A1501 to setting B1602 (see setting B1602 of FIG. 16) and based on this, the setting A1501 is changed to a value lower than the setting B1602 by 4 dB (see setting A1601 of FIG. 6) and the setting C1503 is changed to a value higher than the setting B1602 by 4 dB (see setting C1603 of FIG. 16) and the setting D1504 is changed to a value higher than the setting B1602 by 6 dB (see setting D1604 of FIG. 16). The difference amounts of the change values are one example and are not limited to these values.

By depression of the "volume" button of memory setting by the input device 102, all the parameters other than the volume are the same and only the volume value gives the difference and thereby, a communication function 205 writes into the hearing aid 101 through an adjusting unit 102 (step S207 of FIG. 13) and stores each memory data in the side of the hearing aid 101. Memory setting of the hearing aid 101 is made in a state of memory A as default by memory switching device 209. Then, by depression of a memory switching button by an input device (not shown) (step S208 of FIG. 13), a change from the state of memory A as default to memory B in which the volume value rises by 4 dB is made by the memory switching device 209 (S209 of FIG. 13) and by depression of the memory switching button by the input device (not shown), a change to memory C in which the volume value further rises by 4 dB is made by the memory switching device 209 (S210 of FIG. 13) and by depression of the memory switching button by the input device (not shown) again, a change to memory D in which the volume value further rises by 2 dB is made by the memory switching device 209 (step S211 of FIG. 13). Further, when the memory switching button is depressed by the input device (not shown) again from the memory D, a change to the memory A is made by the memory switching device 209 (S212 of FIG. 13). In addition, the memory switching (change) is optional.

In addition, in the case of performing memory switching by the memory switching device 209, it may be constructed so as to provide notification to the effect that the memory switching is performed by a notification device (not shown).

By the above, the memory switching function not only can change surrounding setting but also can easily implement a change in only the volume value by only the depression of the memory switching button, and trouble in the volume change by a wearer can be reduced.

According to such a hearing aid adjusting apparatus 104 of the third embodiment of the invention, the hearing aid adjusting apparatus has the input device 201 for accepting an operation input, the storage 203 for storing the parameter every predetermined surrounding setting, the controller 202 for controlling the parameter every the surrounding setting, the display 204 for displaying information about the parameter, and the communication device 205 for sending a signal including a parameter every the surrounding setting for storage in a storage 208 of the hearing aid 101, so that the memory switching device 209 of the hearing aid 101 can be used as use of a volume switching button by changing only the volume in each of the surrounding settings, so that the hearing aid adjusting apparatus can have an effect of improving convenience of a wearer.

In addition, in the embodiment, the case where the volume button is mainly selected and only volume condition is set with the difference disposed stepwise has been described, but only information about particular parameters (for example, surrounding noise suppression, moderato, howling suppression or low noise reduction) other than the volume can also be set with the difference disposed stepwise.

Figure 17:
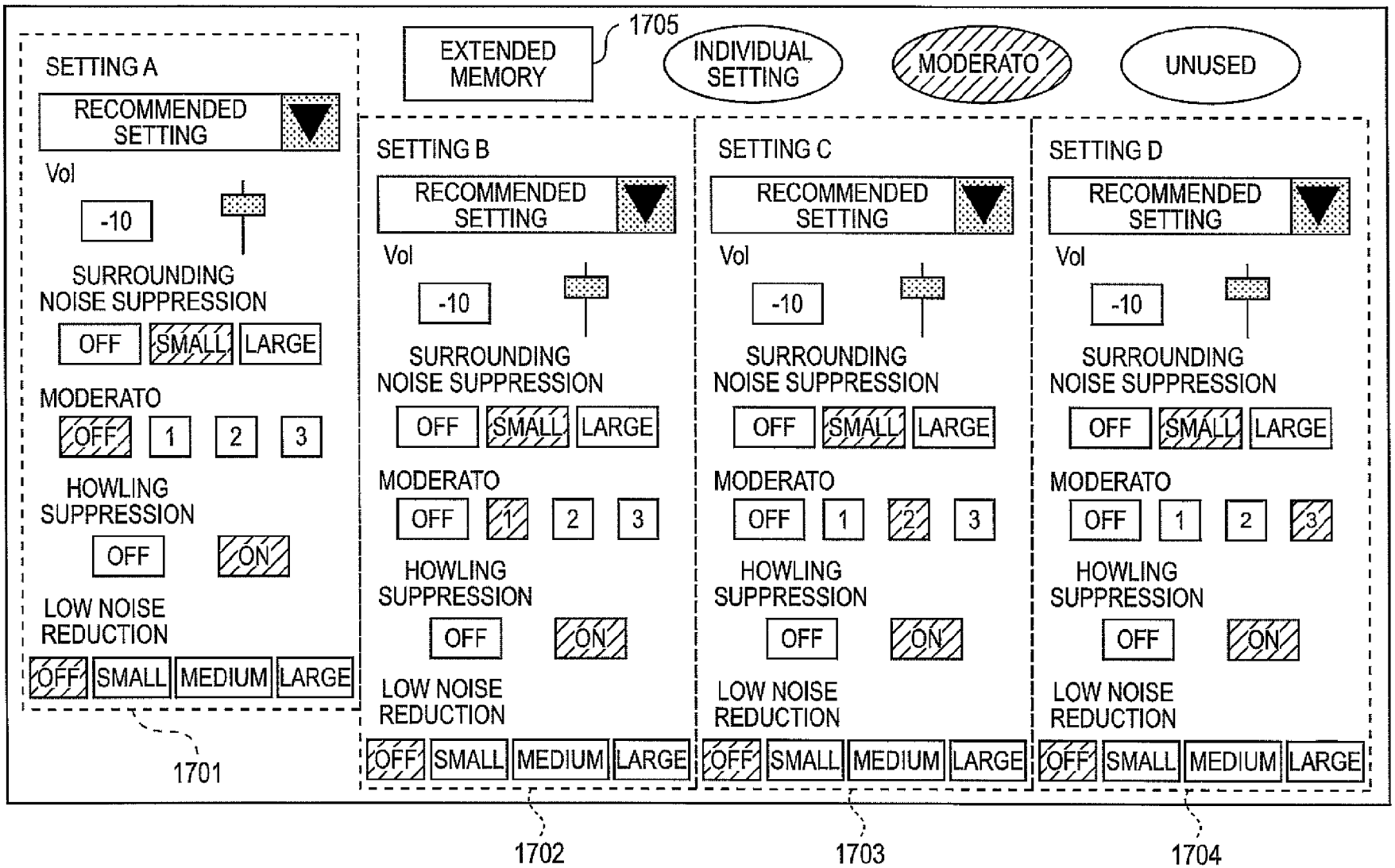
FIG. 17 is a GUI of the hearing aid adjusting apparatus in the third embodiment of the invention (after depressing a moderato button).

The case of collectively changing moderato as a particular parameter will herein be described. FIG. 17 shows a GUI (after depression of a moderato button) of the hearing aid adjusting apparatus 104. In FIG. 17, the moderato rather than the volume is prepared as an "extended memory" label. Processing of the case of setting information about the moderato as shown in FIG. 17 differs from processing (processing of the case of setting information about the volume) of FIG. 13 in the processing of steps S204 and S206.

That is, in step S204, in the memory setting screen of FIG. 14, the "moderato" button of the extended memory 1405 is depressed and selected using the input device 201. Then, in step S206, all the parameters set in setting A1401 other than the moderato are duplicated to setting B1402 to setting D1404 by the controller 202. Here, in only the moderato, the controller 202 sets moderato values of setting A1701 to setting D1704 so as to differ respectively. In FIG. 17, the moderato value of the setting A1701 is set as "OFF" and the moderato value of the setting B1702 is set as "1" and the moderato value of the setting C1703 is set as "2" and the moderato value of the setting D1704 is set as "3". In addition, the change values are one example and are not limited to these values.

Thus, the input device 201 accepts selection of a label for changing predetermined information (moderato, etc) included in a parameter and the controller 202 collectively changes the predetermined information (moderato, etc) about all the surrounding settings based on the selection of the label and thereby, the memory switching device 209 of the hearing aid 101 can be used as use of a switching button for switching the predetermined information, so that it can have an effect of improving convenience of a wearer.

In addition, a computer may be allowed to function as a part or all of the hearing aid adjusting apparatus of the embodiment. Then, it is a program, so that a part or all of the hearing aid adjusting apparatus of the embodiment of the invention can easily be implemented using a general-purpose computer or a server. Further, installation work or distribution of a program can simply be performed by delivering the program using a communication line or being stored in a computer-readable storage medium.

As described above, by operating one of plural surrounding settings selected, all the parameters selected can be collectively converted by interlock, so that in the case of intending to be adjusted to setting similar to source setting, each parameter can be duplicated at once without being changed one by one, so that the invention has an effect of saving effort of adjustment time and is useful as a hearing aid adjusting apparatus etc. having a function of fitting software for adjusting a hearing aid.

Further, the invention comprises controller for controlling a parameter such as gain or volume every surrounding setting and memory can be stored in a hearing aid every plural surrounding settings, so that a parameter other than the volume is duplicated in a storage to other plural surrounding settings based on standard recommended setting in the controller and thereby, a memory switching device of the hearing aid can be used as use of a volume switching button by changing only the volume in each of the surrounding settings, so that the invention has an effect of improving convenience of a wearer and is useful as a hearing aid adjusting apparatus etc. having a function of fitting software for adjusting the hearing aid.

What is claimed is:

1. A hearing aid adjusting apparatus for adjusting parameters of a hearing aid, comprising:

an input device for accepting an operation input;

a storage for storing the parameters for each of predetermined surrounding settings;

a controller for controlling the parameters for each of the surrounding settings; and a display for displaying information about the parameters, wherein the input device accepts selection of plural surrounding settings, and wherein the controller collectively converts the parameters in the selected surrounding settings based on the operation by the input device.

2. The hearing aid adjusting apparatus according to claim 1, wherein the input device accepts a selection of the plural surrounding settings and the parameters in the plural surrounding settings and operates the selected parameters of one of the selected surrounding settings, and the controller collectively converts the selected parameters in the selected surrounding settings based on the operation by the input device.

3. The hearing aid adjusting apparatus according to claim 1, wherein the controller duplicates an originally operated surrounding setting or parameters in the originally operated surrounding setting to other surrounding setting different from the originally operated surrounding setting or parameters in the other surrounding setting based on the operation by the input device.

4. The hearing aid adjusting apparatus according to claim 3, wherein the controller inhibits duplication to the parameters in the other surrounding setting when predetermined data is not set in the parameters in the originally operated surrounding setting.

5. The hearing aid adjusting apparatus according to claim 1, wherein the controller moves the originally operated surrounding setting between other two surrounding settings different from the originally operated surrounding setting based on the operation by the input device.

6. The hearing aid adjusting apparatus according to claim 3, wherein the input device drags the originally operated surrounding setting and drops it to a surrounding setting of an operation destination.

7. The hearing aid adjusting apparatus according to claim 1, wherein the display device further displays a dialog as to whether or not a control by the controller is to be performed.

8. The hearing aid adjusting apparatus according to claim 1, further having a communication device for sending a signal including the parameters for each of the surrounding settings for storing in a memory of the hearing aid.

9. The hearing aid adjusting apparatus according to claim 8, wherein the input device accepts selection of a label for changing predetermined information included in the parameters, and the controller collectively changes the predetermined information about all the surrounding settings based on the selection of the label.

10. The hearing aid adjusting apparatus according to claim 8, wherein the input device accepts selection of a volume label for changing condition about volume included in the parameters, and the controller collectively changes the condition about the volume of all the surrounding settings based on the selection of the volume label.

11. The hearing aid adjusting apparatus according to claim 8, wherein the controller duplicates a parameter other than a condition about a volume of first surrounding setting included in the plural surrounding settings to a parameter other than the condition about a volume of a surrounding setting other than the first surrounding setting.

12. The hearing aid adjusting apparatus according to claim 8, wherein the controller sets a condition about a different volume in each surrounding setting based on a condition about a volume of first surrounding setting included in the plural surrounding settings.

13. The hearing aid adjusting apparatus according to claim 10, wherein the display further displays a dialog as to whether or not control by the controller is to be performed.

14. The hearing aid adjusting apparatus according to claim 10, wherein the controller performs modal display on the display at the time of displaying a memory setting screen showing the performing of a control by the controller.

15. A hearing aid adjusting apparatus for adjusting parameters of a hearing aid, comprising:

an input device for accepting an operation input;

a storage for storing the parameters for each of predetermined surrounding settings;

a controller for controlling the parameters for each of the surrounding settings;

a display for displaying information about the parameters; and a communication device for sending a signal including the parameters for each of the surrounding settings for storing in a memory of the hearing aid.

16. The hearing aid adjusting apparatus according to claim 15, wherein the input device accepts selection of a label for changing predetermined information included in the parameters, and the controller collectively changes the predetermined information about all the surrounding settings based on the selection of the label.

17. The hearing aid adjusting apparatus according to claim 15, wherein the input device accepts selection of a volume label for changing a condition about volume included in the parameters, and the controller collectively changes the condition about the volume of all the surrounding settings based on the selection of the volume label.

18. The hearing aid adjusting apparatus according to claim 15, wherein the controller duplicates a parameter other than condition about volume of first surrounding setting included in the plural surrounding settings to a parameter other than condition about volume of surrounding setting other than the first surrounding setting.

19. The hearing aid adjusting apparatus according to claim 15, wherein the controller sets a condition about a different volume in each surrounding setting based on a condition about a volume of first surrounding setting included in the plural surrounding settings.

20. The hearing aid adjusting apparatus according to claim 17, wherein the display further displays a dialog as to whether or not a control by the controller is performed.

21. The hearing aid adjusting apparatus according to claim 17, wherein the controller performs modal display on the display at the time of displaying a memory setting screen showing the performing of a control by the controller.

22. A hearing aid comprising:

a communication device for receiving a signal including parameters for each of predetermined surrounding settings from a hearing aid adjusting apparatus for adjusting the hearing aid;

a storage for storing the parameters for each of the predetermined surrounding settings; and a memory switching device for switching the predetermined surrounding settings.

23. The hearing aid according to claim 22, further comprising a notification device for providing a notification to inform that a switching is performed when the surrounding setting is switched by the memory switching device.

24. A computer readable recording medium storing a program for configuring a computer to function as the hearing aid adjusting apparatus according to claim 1, the program including instructions for configuring the computer to:

accept the operation input;

store the parameters for each of the predetermined surrounding settings;

control the parameters for each of the surrounding settings;

generate information to be displayed about the parameters; and collectively convert the parameters in the selected surrounding setting based on the operation input.

25. A computer readable recording medium storing a program for configuring a computer to function as the hearing aid adjusting apparatus according to claim 15, the program including instructions for configuring the computer to:

accept the operation input;

store the parameters for each of the predetermined surrounding settings;

control the parameters for each of the surrounding settings;

generate information to be displayed about the parameters; and generate a signal to be sent including the parameters for each of the surrounding settings for storing in a memory of the hearing aid.

26. A computer readable recording medium storing a program for configuring a computer to function as the hearing aid adjusting apparatus according to claim 22, the program including instructions for configuring the computer to:

store the parameters for each of the predetermined surrounding settings; and switch the predetermined surrounding settings.

27. The hearing aid adjusting apparatus according to claim 1, wherein when the input device selects a surrounding setting of a duplication source and a surrounding setting of a duplication destination, the controller collectively duplicates all parameters of the surrounding setting of the duplication source to the surrounding setting of the duplication destination.

* * * * *